US005598695A

United States Patent [19]

Kaneko et al.

[11] Patent Number: 5,598,695

[45] Date of Patent: Feb. 4, 1997

[54] ROTOR TYPE OPEN-END SPINNING UNIT HAVING OUTER AND INNER ROTORS

[75] Inventors: Masashi Kaneko; Noriaki Miyamoto; Yasuyuki Kawai; Hisaaki Hayashi, all of Kariya, Japan

[73] Assignee: Kabushiki Kaisha Toyoda Jidoshokki Seisakusho, Kariya, Japan

[21] Appl. No.: 507,094

[22] Filed: Jul. 26, 1995

[30] Foreign Application Priority Data

| | | | |
|---|---|---|---|
| Aug. 5, 1994 | [JP] | Japan | 6-184976 |
| Aug. 22, 1994 | [JP] | Japan | 6-196677 |
| Apr. 20, 1995 | [JP] | Japan | 7-095585 |

[51] Int. Cl.[6] ..... D01H 4/00

[52] U.S. Cl. ..... 57/413; 57/411

[58] Field of Search ..... 57/404, 408, 409, 57/410, 411, 413

[56] References Cited

U.S. PATENT DOCUMENTS

| | | | |
|---|---|---|---|
| 3,605,395 | 9/1971 | Morikawa et al. | 57/409 |
| 3,943,690 | 3/1976 | Noguera | 57/406 |
| 3,958,403 | 5/1976 | Wehling | 57/406 |
| 4,044,537 | 8/1977 | Negishi et al. | 57/406 |
| 4,593,522 | 6/1986 | Ishizuka et al. | 57/404 |
| 4,625,506 | 12/1986 | Beckers | 57/404 |
| 5,359,846 | 11/1994 | Miyamoto et al. | 57/404 |
| 5,406,783 | 4/1995 | Kaneko et al. | 57/404 |

FOREIGN PATENT DOCUMENTS

| | | | |
|---|---|---|---|
| 46-4853 | 2/1971 | Japan | 57/409 |
| 46-7619 | 2/1971 | Japan | 57/411 |
| 6-2228 | 1/1994 | Japan | 57/413 |
| 6-123020 | 5/1994 | Japan | 57/263 |

*Primary Examiner*—William Stryjewski
*Attorney, Agent, or Firm*—Brooks Haidt Haffner & Delahunty

[57] ABSTRACT

A rotor type open-end spinning unit has a collecting section collecting an opened and supplied fiber to make a fiber bundle. The fiber bundle is drawn through a yarn drawing passage to spin a yarn while twisting the fiber bundle. A rotatable outer rotor has an open end, a closed end and a peripheral wall. The peripheral wall has the collecting section on an inner surface thereof. The collecting section is located on a plane perpendicular to the rotational axis of the rotor. An inner rotor is located in the outer rotor and is driven independently. The inner rotor faces an end of the yarn drawing passage. A yarn path is provided with the inner rotor for guiding the fiber bundle from the collecting section to the yarn drawing passage. A first guide is provided with the inner rotor for contacting the fiber bundle guided to the yarn drawing passage through the yarn path from a frontward location with respect to the rotational direction of the inner rotor. A second guide is located frontward of the first guide and between the first guide and the inner surface of the outer rotor. The second guide guides the yarn toward the yarn drawing passage in cooperation with the first guide.

25 Claims, 17 Drawing Sheets

ROTOR TYPE OPEN-END SPINNING UNIT HAVING OUTER AND INNER ROTORS

BACKGROUND OF THE INVENTION

1. Field of the Invention

The present invention relates to a rotor type open-end spinning unit. More particularly, this invention relates to a spinning frame that has an outer rotor, which is provided with a collecting section for collecting opened fibers supplied, and an inner rotor, which is provided inside the outer rotor and is driven independently of the outer rotor.

2. Description of the Related Art

In an ordinary rotor type open-end spinning frame, a supplied sliver is opened by a combing roller and foreign matter is expelled. The opened fibers are supplied into a rotor by an airstream produced in a fiber transport channel due to negative pressure in the rotor, that rotates at a high speed. The fibers are then collected at a fiber-collecting section at the largest inner diameter portion of the rotor. The collected fibers are drawn from a guide hole or a yarn drawing passage, provided in the center of a navel, by a draw roller, and is simultaneously twisted in accordance with the rotation of the rotor to form a yarn. The yarn is then wound around a bobbin as a package.

It is known that open-end spinning frames have a higher productivity than ring spinning frames. In general, however, a fabric woven with yarn produced by an open-end spinning frame (hereinafter called open-end yarn) has a poorer texture than a fabric woven with yarn produced by a ring spinning frame (hereinafter called ring yarn). When fibers flown into the twisting area are wound around yarn that is being formed, the appearance of the yarn is deteriorated. Further, the open-end yarn has a lower strength than the ring yarn.

The present inventor thought that the poor texture of the manufactured fabric could be the result of the difference in structure between the open-end yarn and the ring yarn. The conventional open-end yarn has a prominent rough surface as if formed by twisting a ribbon or a tape, whereas the ring yarn has a relatively smooth outer surface. This may be because, in the conventional open-end spinning frame, as shown in FIG. 26, a fiber bundle F to be drawn to the guide hole (not shown) from a fiber-collecting section 72 of a rotor 71 is drawn from a separation point P almost vertically to the inner wall of the rotor 71. Because the angle θ between the fiber bundle F (yarn Y) at the separation point P and the inner wall of the rotor 71, or the twisting angle θ with respect to the fiber bundle F, is substantially 90 degrees, the fiber bundle F is bent by nearly 90 degrees so that tension is always applied to the outer fiber at the bent portion of the fiber bundle F while the inner fiber become slack. As the fiber bundle F is twisted under this condition, yarn is formed with fibers with lower tension wound around higher-tension fibers located at the center. As a result, the produced yarn becomes wavy and prominently shows a rough outer surface.

As a solution to the shortcoming of the conventional open-end yarn, another apparatus is disclosed in Japanese Unexamined Patent Publication No. 51-64034. This apparatus has a rotor having a fiber-collecting section or an outer rotor, and a draft rotor or an inner rotor, which is provided inside the outer rotor. This apparatus has a yarn drawing hole for drawing a fiber bundle collected at the collecting section and makes a differential rotation with respect to the outer rotor.

As shown in FIG. 27, this apparatus has an inner rotor 74 concentrically provided inside an outer rotor 73. The inner rotor 74 rotates slightly faster than the outer rotor 73 and the fiber bundle F is drawn through a yarn drawing hole 75 of the inner rotor 74. Accordingly, this apparatus spins out the fiber bundle F while drafting it. The aforementioned publication also discloses an apparatus that has a small disk 76, which is attached to the inner rotor 74 and revolves and rotates while being pressed against the fiber bundle F collected at the collecting section, as shown in FIG. 28(*a*). This apparatus spins out the fiber bundle F while drafting it with the floating of the fiber bundle F suppressed.

When the rotation speeds of both rotors 73 and 74 in the apparatus shown in FIG. 27 are relatively low, about 30,000 rpm, the fiber bundle F separated from the collecting section can be spun out along a gentle curve from the separation point P to the yarn drawing hole 75 as indicated by the solid line in FIG. 27. When the rotational speeds of the rotors become as fast as about 90,000 rpm, however, the fiber bundle F moving toward the yarn drawing hole 75 from the collecting section is stretched straight to very near the collecting section by the increased centrifugal force as indicated by the chain line. Consequently, the twisting angle becomes approximately 90 degrees, raising the above-discussed problem of the conventional open-end spinning frame having no inner rotor 74.

In the apparatus with the small disk 76 as shown in FIG. 28(*a*), it is possible to set the separation point P at a position immediately downstream of the position where the small disk 76 presses the fiber bundle F against the collecting section as shown in FIG. 28(*a*) by increasing the yarn drawing speed (winding speed) to increase the draft ratio when the rotational speed of the rotor becomes high. However, if the draft ratio is increased, the pressure by which the fiber bundle F contacts a point D of the end portion of the yarn drawing hole 75 raises so that twisting is hardly transmitted upstream from the point D, as shown in FIG. 28(*b*). This prevents the fibers collected at the collecting section from being drawn out. When the twisting force is increased to transmit twisting to the separation point P, bridge fibers Fb are produced between the inlet of the yarn drawing hole 75 and the point P and are wound around the fiber bundle F in a coil form. This yields so-called neck-wound fibers, which deteriorate the appearance of the yarn. This yarn reduces the texture quality of a fabric that is produced with the yarn.

When the pressure at which the small disk 76 contacts the outer rotor 73 is large, the inner rotor 74 causes the outer rotor 73 to rotate, making it difficult to rotate the inner rotor 74 and the outer rotor 73 with a predetermined speed difference. As the small disk 76 rotates while being in contact with the outer rotor 73, the small disk 76 or the outer rotor 73 is likely to wear.

SUMMARY OF THE INVENTION

It is therefore a primary object of the present invention to provide a rotor type open-end spinning frame which can twist fibers constituting a fiber bundle that is to be drawn out while being twisted, into yarn while being stretched in a relatively straight fashion, thereby improving the texture of a fabric manufactured with this yarn. In addition, this can be accomplished at a high speed.

To achieve the above object, a rotor type open-end spinning unit has a collecting section collecting an opened and supplied fiber to make a fiber bundle. The fiber bundle is drawn through a yarn drawing passage to spin a yarn while twisting the fiber bundle. A rotatable outer rotor has an open-end, a closed end and a peripheral wall. The peripheral wall has the collecting section on an inner surface thereof. The collecting section is located in a plane normal to the rotational axis of the rotor. An inner rotor is located in the outer rotor and is driven independently. The inner rotor faces an end of the yarn drawing passage. A yarn path is provided with the inner rotor for guiding the fiber bundle from the collecting section to the yarn drawing passage. A first guide is provided with the inner rotor for contacting the fiber bundle guided to the yarn drawing passage through the yarn path from a frontward location with respect to the rotational direction of the inner rotor. A second guide is located frontward of the first guide and between the first guide and the inner surface of the outer rotor. The second guide guides the yarn toward the yarn drawing passage in cooperation with the first guide.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
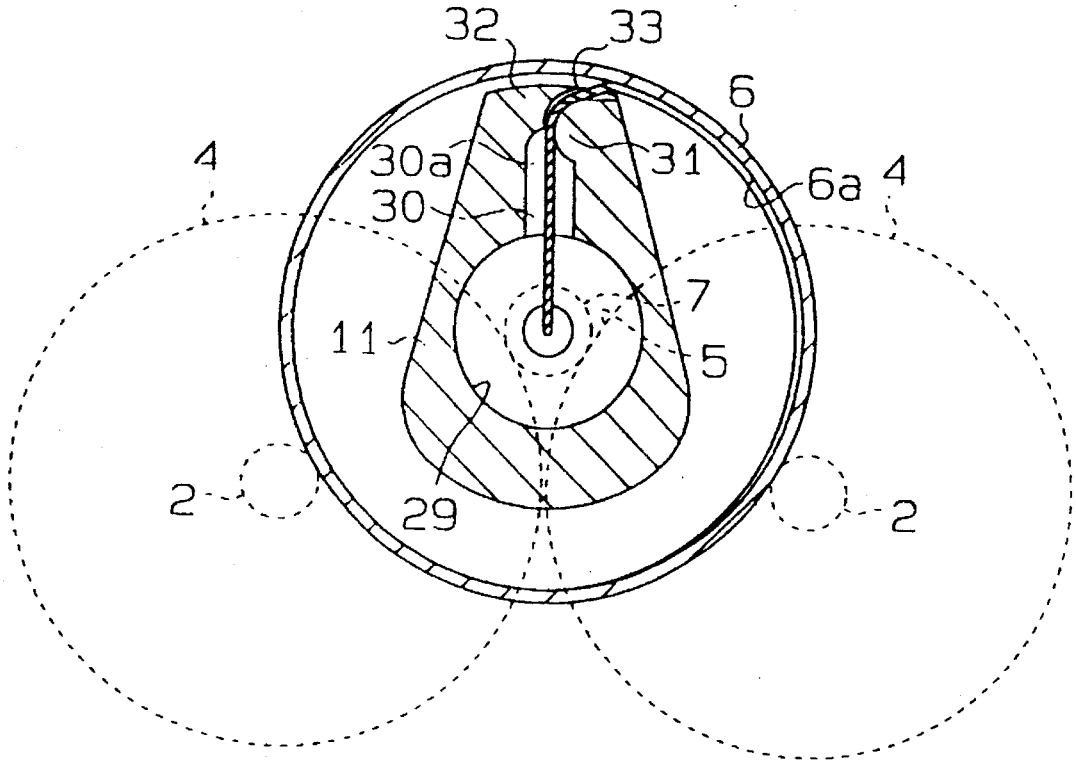
FIG. 1 is a partial cross-sectional view of a first embodiment of the present invention showing the relationship between an outer rotor and an inner rotor and the relationship between a support disk and a rotor shaft, as viewed from the opening side of the outer rotor.

A first embodiment of the present invention will now be described referring to FIGS. 1 through 3. As shown in FIGS. 1 and 3, a pair of drive shafts 2 are supported parallel to each other, with a bearing 3 on a base 1 secured to a frame (not shown). Support disks 4 are fitted on both sides of each drive shaft 2 so as to be rotatable with that drive shaft 2. A pair of adjoining support disks 4 define a wedge-shaped recess 5, as shown in FIG. 1. A hollow rotor shaft 7 with an outer rotor 6 securely fitted on the distal end thereof is supported in the recess 5 in such a manner that the outer surface of the rotor shaft 7 contacts the individual support disks 4. A drive belt 8 common to a plurality of spindles is arranged between the two pairs of support disks 4 in a direction perpendicular to the rotor shaft 7 with the rotor shaft 7 pressed against the support disks 4. The drive belt 8 is driven by a drive motor (not shown), and the rotor shaft 7 rotates with running of the drive belt 8.

Bearings 9 are secured in large-diameter portions 7(*a*) formed at both ends of the rotor shaft 7, and a shaft 10 penetrating through the rotor shaft 7 is rotatably supported coaxial to the rotor shaft 7 via the bearings 9. The shaft 10 has a distal end on which an inner rotor 11 is rotatably fitted, and a proximal end abuts on a thrust bearing 12. A drive belt 13, provided common to a plurality of spindles, like the drive belt 8, is pressed against the shaft 10 so as to run in the direction perpendicular to the shaft 10. As the drive belt 13 runs, the shaft 10 rotates.

The thrust bearing 12 has a case 14 retaining a lubrication oil O, an oil supplying member 15 made of felt, a ball 16 rotatably supported on the oil supplying member 15, and an adjusting screw 15*a* which abuts on the ball 16 from the opposite side of the shaft 10. The support disks 4 are secured to the drive shafts 2 with slight inclination so that at the time the support disks 4 rotate in accordance with the rotation of the rotor shaft 7, a thrust load directed toward the thrust bearing 12 acts on the rotor shaft 7. The thrust load acting on the rotor shaft 7 is transmitted by the bearings 9 to the shaft 10 and is received by the thrust bearing 12.

A housing 17 is disposed to face the open side of the outer rotor 6, and a boss 18 is formed on the housing 17 so as to protrude inside the outer rotor 6. Bored in the boss 18 is one end of a fiber transport channel 22, which guides fibers, supplied by the actions of a feed roller 19 and a presser 20 and opened by a combing roller 21, into the outer rotor 6. A navel 24 in which one end of a yarn drawing passage 23 is bored is provided in the center of the boss 18. A yarn pipe 25, which constitutes a part of the yarn drawing passage 23, is laid so as to cross the center line of the navel 24, and its end portion 25*a* closer to the navel 24 of the yarn pipe 25 is a yarn (fiber bundle F) twist start point. A casing 26, which covers the outer rotor 6, abuts via an O-ring 27 on the end surface of the housing 17. The casing 26 is connected via a pipe 28 to a negative pressure source (not shown in FIG. 3).

The inner rotor 11 is designed so that part of its surface extends to the proximity of a fiber-collecting section 6*a* of the outer rotor 6, and has a recess 29 formed in the center portion of the inner rotor 11, in which the navel 24 is loosely fitted. The recess 29 also constitutes a part of a yarn passage 30. The radius of the largest outside-diameter portion of the inner rotor 11 is set larger than the radius of the inner wall of the opening of the outer rotor 6. A passage 30*a* is formed at the largest outside-diameter portion of the inner rotor 11, extending in the radial direction thereof. The passage 30*a* has one end open in the vicinity of the fiber-collecting section 6*a* of the outer rotor 6 and the other end open in the surface of the recess 29. The recess 29 and the passage 30*a* constitute the yarn path 30. The yarn path 30 is located on the plane where the collecting section 6*a* is positioned, and serves to guide the fiber bundle F from the vicinity of the collecting section 6*a* to the position at which it faces the yarn drawing passage 23.

Figure 2:
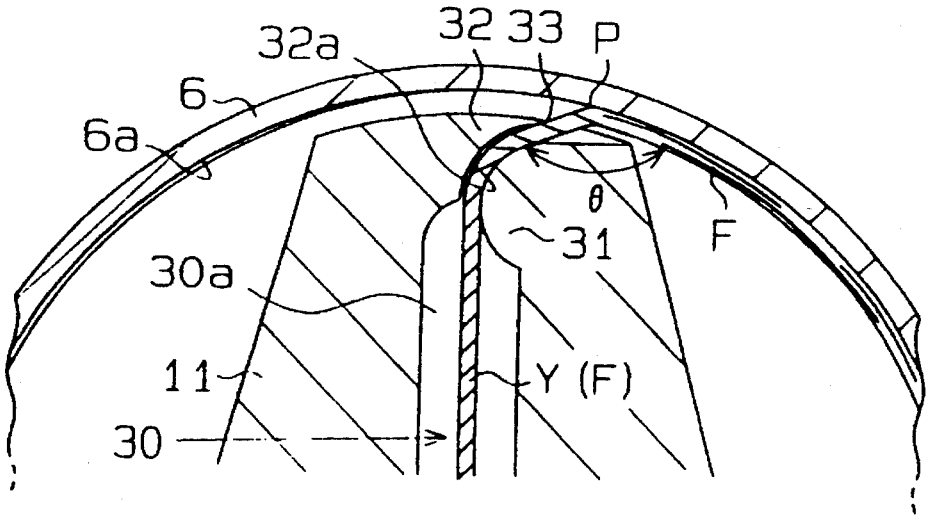
FIG. 2 is a partial enlarged cross-sectional view of the outer rotor and inner rotor.
Figure 3:
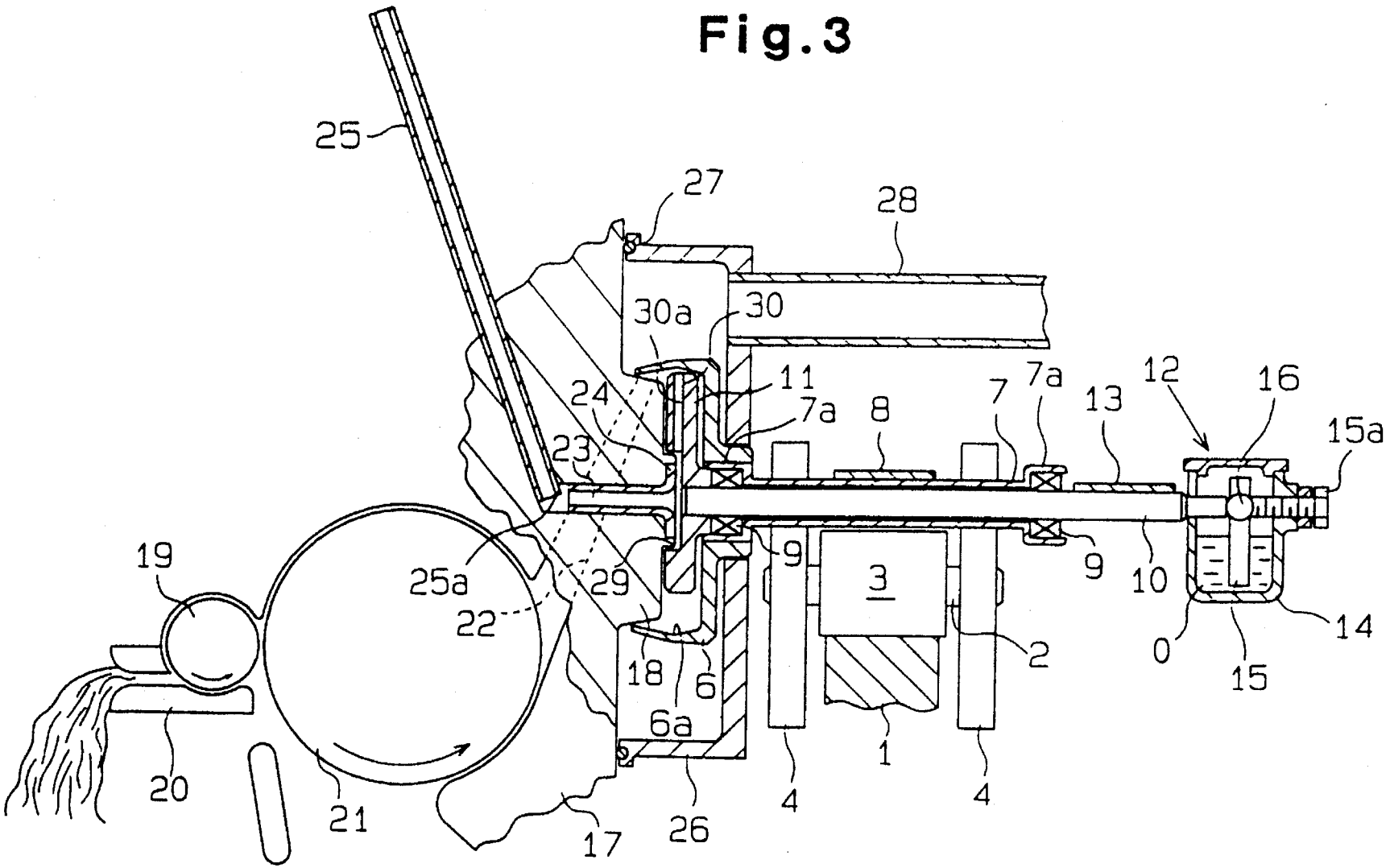
FIG. 3 is a partial cross-sectional view of an open-end spinning frame.

As shown in FIGS. 1 and 2, a first guide 31 is disposed at the distal end of the inner rotor 11 in the proximity of the entrance of the yarn path 30, and is located on the forward side in the rotational direction of the inner rotor 11 with respect to the yarn path 30. The first guide 31 is formed in a substantially semi-cylindrical shape. The first guide 31 can contact the fiber bundle F, which is led to the yarn drawing passage 23 via the yarn path 30 from the forward or leading side (the right side in FIG. 1) with respect to the rotational direction (clockwise as viewed in FIG. 1) of the inner rotor 11. Formed opposite the first guide 31 is a wall 32 having a surface 32*a* which extends along the curved surface of the first guide 31. The distal end of the wall 32 is located forward of or leads the curved surface of the first guide 31 with respect to the rotational direction of the inner rotor 11, and this distal end forms a second guide 33. Therefore, the wall 32 inhibits fibers in the outer rotor 6 from entering the yarn path 30 downstream of the second guide 33, that is, from the rearward of lagging side with respect to the rotational direction of the inner rotor 11.

The inner rotor 11 is made of metal such as aluminum or aluminum alloy. The surfaces of both guides 31 and 33 and the wall 32 are subjected to plating, ion plating or the like, so that hard layer such as a chromium-plated layer or a titanium nitride layer, which has an excellent wear resistance, is formed.

The action of the thus structured spinning frame will now be described. In spinning mode, the drive belts 8 and 13 run in the same direction to rotate the outer rotor 6 and inner rotor 11 in the same direction via the rotor shaft 7 and the shaft 10. The rotational speed of the inner rotor 11, which is different from that of the outer rotor, is the speed of separation of the fiber bundle F from the fiber-collecting section 6*a*. This is slightly faster than the rotational speed of the outer rotor 6. In this state, the fibers, which have been opened by the action of the combing roller 21, are fed into the outer rotor 6 via the fiber transport channel 22 and slide along the inner wall of the outer rotor 6 to be collected at the collecting section 6*a*. The fiber bundle F collected at the collecting section 6*a* is linked to the yarn Y which is drawn via the yarn pipe 25 by the feed roller (not shown). As the yarn Y is drawn, therefore, the fiber bundle F is separated from the collecting section 6*a*, and is drawn while being twisted by the rotation of the inner rotor 11. Thus, the yarn Y is made longer. The twisting applied to the yarn Y and the fiber bundle F is transmitted to the collecting section 6*a* of the outer rotor 6 from the end portion 25*a* of the yarn pipe 25 as the starting point.

The fiber bundle F is drawn out at such a speed that the separation point P is set more forward with respect to the rotational direction of the inner rotor 11 than the second guide 33. The fiber bundle F separated from the collecting section 6*a* is introduced into the yarn path 30 while in contact with the second guide 33 and the first guide 31. More specifically, the fiber bundle F is drawn out on the forward side in the rotational direction of the inner rotor 11 while in contact with the arc surface of the first guide 31. Therefore, the angle between the direction of drawing the fiber bundle F at the separation point (twisting point) P and the fiber bundle F collected at the collecting section 6*a*, i.e., the twisting angle θ, becomes obtuse. The difference in passage between the inner fibers and outer fibers of the fiber bundle F, which is twisted while being separated from the collecting section 6*a*, becomes smaller, and the whole fiber bundle F is twisted with substantially uniform force with the fibers stretched almost straight. Consequently, it is less likely that the drawn-out yarn will have a rough surface. Consequently, a fabric produced with this yarn will have better texture.

When both rotors 6 and 11 rotate at a high speed, the centrifugal force acting on the fiber bundle F, which travels toward the first guide 31 from the separation point P, increases, thus increasing the force that presses the fiber bundle F toward the wall of the outer rotor 6. Because the second guide 33, located between the separation point P and the first guide 31, is positioned outward with the yarn path 30 in between, the movement of the fiber bundle F toward the wall of the outer rotor 6 is inhibited. Further, the rigidity of the fiber bundle F prevents the fiber bundle F from being bent after passing the second guide 33 to come in contact with the wall of the outer rotor 6. Even when both rotors 6 and 11 rotate at a high speed of about 90,000 rpm, the twisting angle θ of the fiber bundle F separated from the collecting section 6*a* is always held at an obtuse angle, unlike in the conventional apparatuses.

The yarn path 30 located downstream of the second guide 33 is provided with a wall 32 having a surface 32*a*, which extends along the curved surface of the first guide 31. Accordingly, the fiber bundle F, separated at the separation point P, positively moves in the yarn path 30 along the curved surface. With regard to the second guide 33, the presence of the wall 32 positively inhibits fibers from flying into the fiber bundle F on the rearward or lagging side of the guide 33, thus preventing the occurrence of neck-wound fibers.

Figure 4:
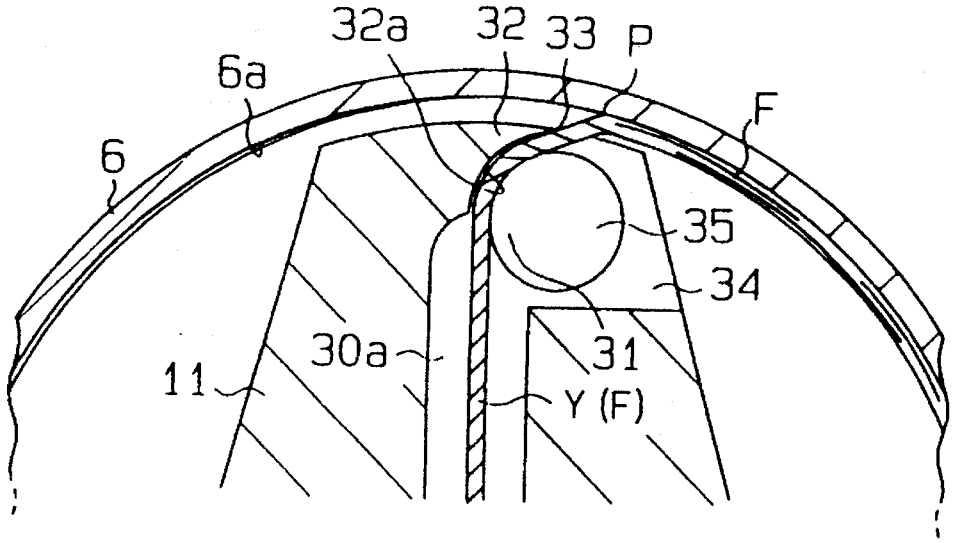
FIG. 4 is a partial enlarged cross-sectional view of a second embodiment.

A second embodiment will now be described with reference to FIG. 4. This embodiment differs from the first embodiment only in the structure of the first guide provided at the distal end of the inner rotor 11. Formed at the distal end of the inner rotor 11 is a retaining section 34, which makes the yarn path 30 open to the forward direction of or leading side of the inner rotor 11 and towards the opening of the outer rotor 6. A cylindrical pin 35, which constitutes the first guide, is secured in the retaining section 34 in such a way that a part of its outer surface faces the wall surface 32*a*. This surface 32*a* and the outer surface of the opposing pin 35 therefore constitute the first guide 31. The pin 35 is formed of a ceramic material, such as alumina, aluminum nitride (AlN), silicon carbide or boron nitride, which has an excellent wear resistance.

Both guides 31 and 33 and the wall 32 in this embodiment serve the same purposes as those of the first embodiment. Because the whole inner rotor 11 is formed integrally in the first embodiment, it is relatively troublesome to machine the surface 32*a* and the first guide 31. As the retaining section 34 is formed at the distal end of the inner rotor 11 in the second embodiment, however, the surface 32*a* can be worked after forming the retaining section 34, making the machining of the surface 32*a* easier. As the first guide 31 is constituted by the pin 35, the first guide 31 can be arranged at the desired position simply by securing the pin 35 to a predetermined position.

The first guide 31 through which the fiber bundle F passes with sliding contact is constituted by the ceramic pin 35. Therefore, the durability of the first guide 31 is improved, and when the first guide 31 is so worn after long use that it requires replacing, only the pin 35, not the entire inner rotor 11, needs to be replaced.

A third embodiment will be described below with reference to FIG. 5. This embodiment differs from the first embodiment only in the structures of the second guide 33 and the wall 32. The surface 32*a* of the wall 32 has a planar shape. Formed at the distal end of the inner rotor 11 is an opening portion 11*a* which opens towards the opening of the outer rotor 6. The second guide 33 is constituted by a ceramic pin, which is secured so as to contact the distal end of the wall 32 in the opening portion 11*a*.

Therefore, both guides 31 and 33 and the wall 32 in this embodiment also serve substantially the same purposes as those of the first embodiment. The second guide 33 through which the fiber bundle F passes with sliding contact is constituted by the ceramic pin, so that its durability is improved. Further, when the second guide 33 is so worn after long use that it requires replacing, only the pin, not the entire inner rotor 11, needs to be replaced.

Figure 6:
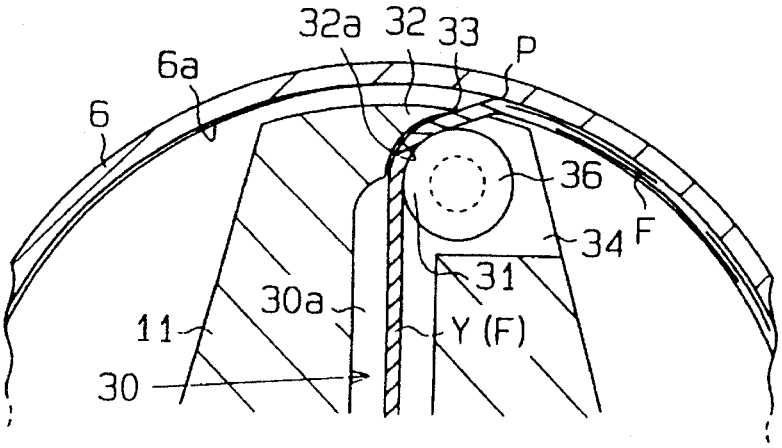
FIG. 6 is a partial enlarged cross-sectional view of a fourth embodiment.

A fourth embodiment will now be described with reference to FIG. 6. This embodiment differs from the second embodiment only in the structure of the first guide. A ceramic roller 36 is rotatably supported in the retaining section 34. The surface of the roller 36, which opposes the surface 32*a*, constitutes the first guide 31. Therefore, this embodiment exhibits the same action and advantages as the second embodiment, and has a reduced drawing resistance because of the rotation of the roller 36 in accordance with the movement of the fiber bundle F so that the first guide has a greater wear resistance.

Figure 7A:
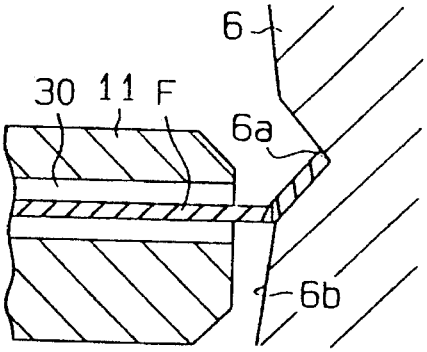
FIGS. 7(*a*), 7(*b*) and 7(*c*) are partial cross-sectional views showing modifications in which a yarn passage is not located on the same plane as a yarn-collecting section.
Figure 7B:
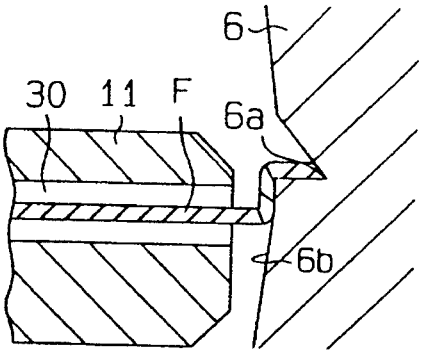
Figure 7C:
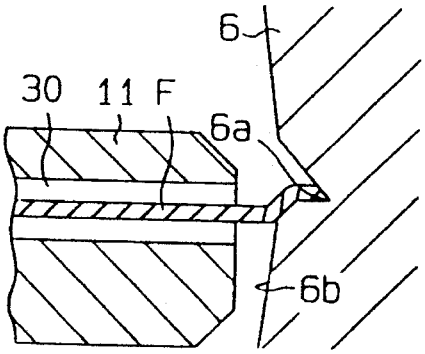

In modifications illustrated in FIGS. 7(*a*) to 7(*c*), the yarn path 30 is located closer to the inside of the outer rotor 6 than to the plane where the collecting section 6*a* is present. In FIGS. 7(*a*) to 7(*c*), the top side is the opening side of the outer rotor 6.

The yarn path 30 is formed so as to correspond to the plane where the collecting section 6*a* is located in the embodiments of FIGS. 1–6. Thus, the fiber bundle F is drawn out straight toward the yarn path 30 along the plane where the collecting section 6*a* is located. The fibers supplied into the outer rotor 6 from the channel 22 slide toward the collecting section 6*a* on the inner wall (sliding wall) positioned closer to the opening of the outer rotor 6 than the collecting section 6*a*. If the fiber bundle F is drawn out straight toward the yarn path 30 from the collecting section 6*a*, therefore, the fibers that slide on the sliding wall, or the inner wall of the rotor 11, toward the collecting section 6*a*, may interfere with the fiber bundle F being drawn into the fiber bundle F (yarn Y). This will deteriorate the appearance of the yarn.

If the yarn path 30 is provided closer to the bottom of the outer rotor 6 than to the plane where the collecting section 6*a* is present, as in the illustrated modifications, the fiber bundle F slides on the inner wall of the outer rotor 6 to the position corresponding to the plane where the collecting section 6*a* is located, and is separated at the position away from the sliding wall. It is therefore less likely that the fibers sliding on the sliding wall will interfere with the fiber bundle F lying between the separation point P and the entrance of the yarn path 30.

In the modification shown in FIG. 7(*a*), the sliding portion of the fiber bundle F simply extends obliquely toward the inner wall 6*b* of the outer rotor 6. In the modification shown in FIG. 7(*b*), the sliding portion of the fiber bundle F has a shape substantially perpendicular to the inner wall 6*b* of the outer rotor 6. In the modification shown in FIG. 7(*c*), the sliding portion of the fiber bundle F extends in a direction substantially perpendicular to the inner wall 6*b* of the outer rotor 6 and then extends obliquely toward the inner wall 6*b*.

Figure 8:
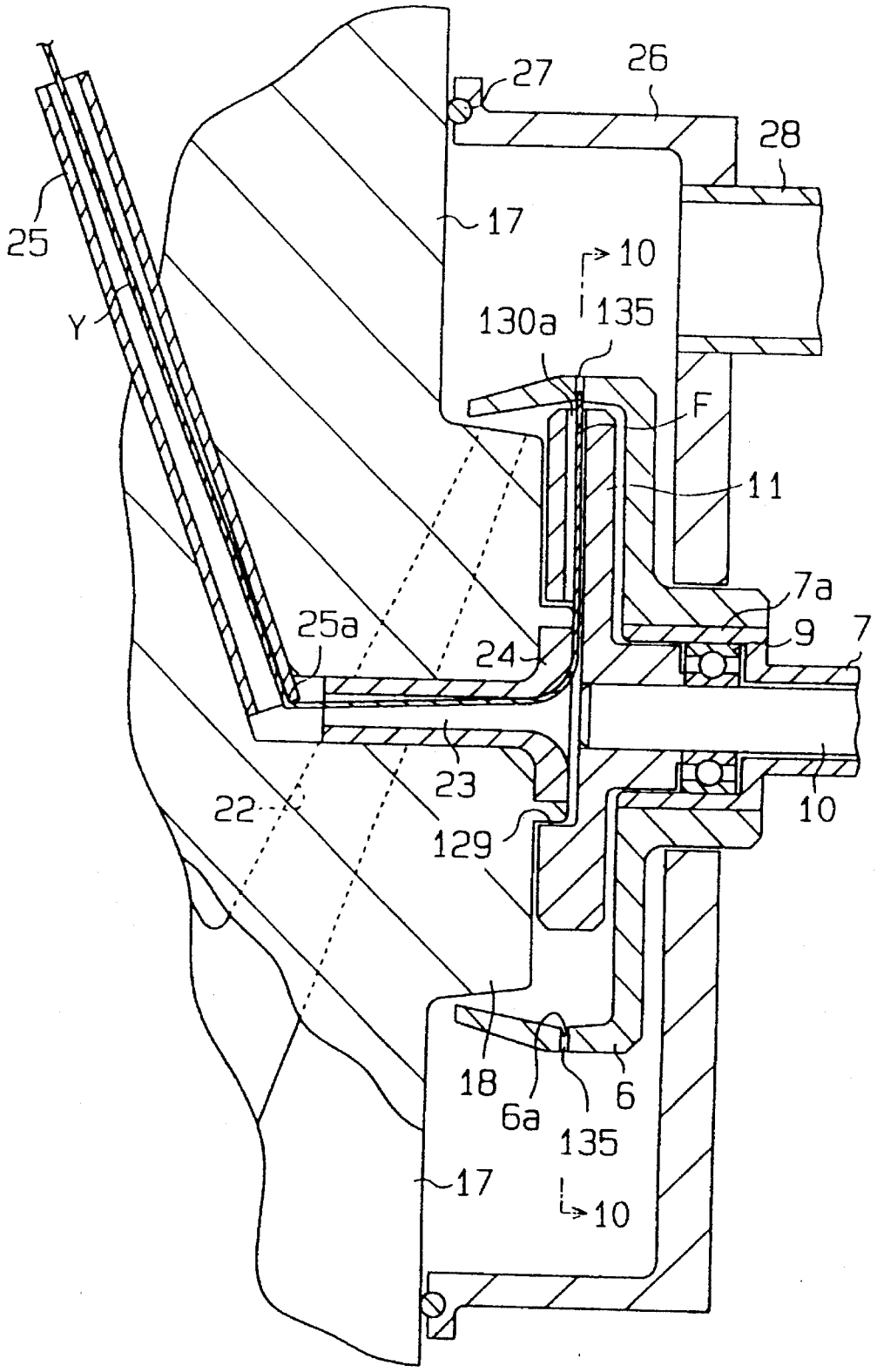
FIG. 8 is a partial enlarged cross-sectional view of the outer rotor and inner rotor of a fifth embodiment.
Figure 9:
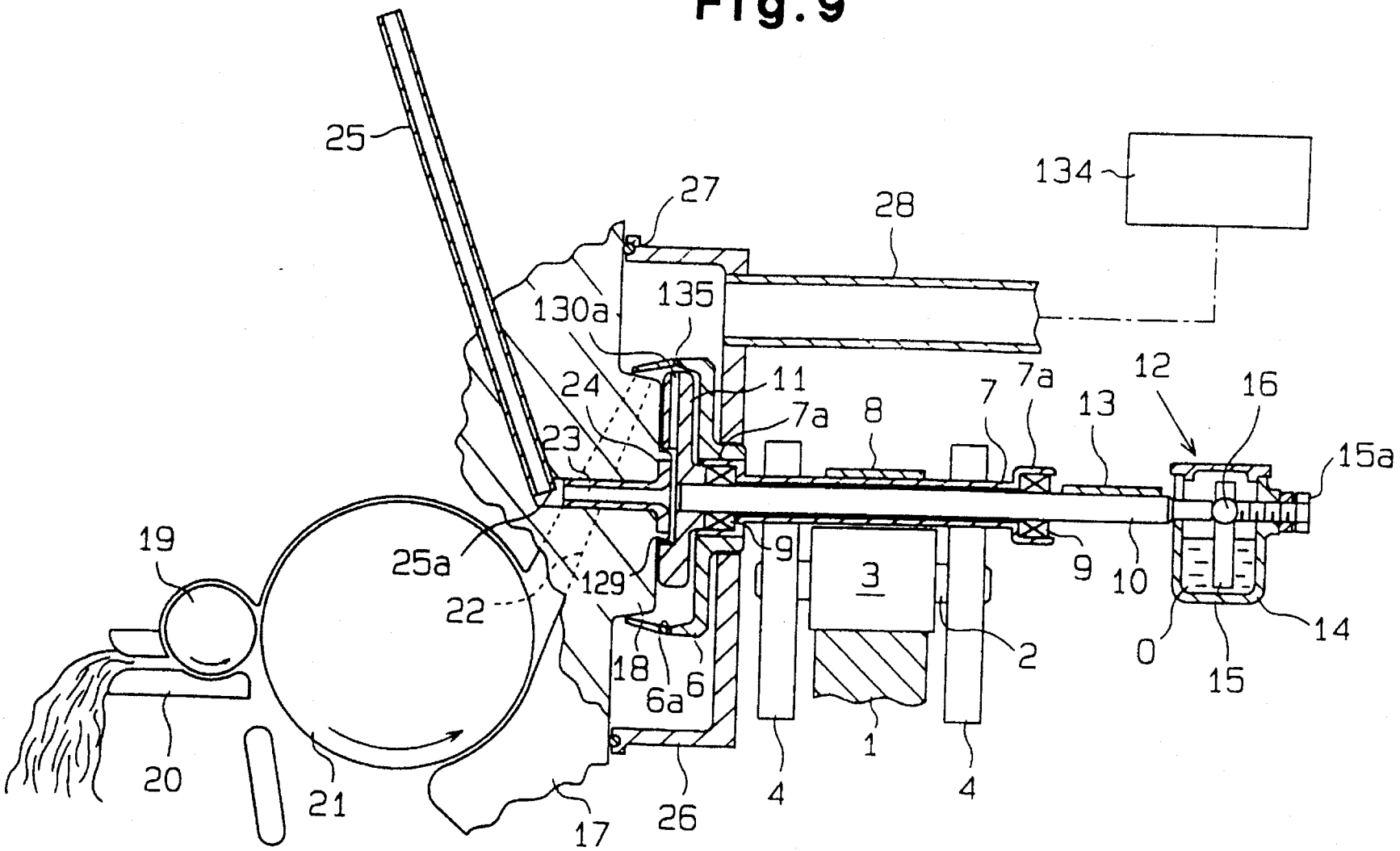
FIG. 9 is a partial cross-sectional view of an open-end spinning frame according to the fifth embodiment.

A fifth embodiment of this invention will be described below with reference to FIGS. 8 through 10. Like or same reference numerals as used for the above-described embodiments will be used to denote corresponding or identical components in this embodiment to avoid repeating their detailed descriptions.

The casing 26 is connected via the pipe 28 to a negative pressure source 134, which can adjust the level of the negative pressure which acts on the casing 26.

A recess 129 where the navel 24 is loosely fitted is formed in the center portion of the inner rotor 11 which faces the boss 18. The largest diameter portion of the inner rotor 11 has a path 130*a* located in the vicinity of the collecting section 6*a* of the outer rotor 6. Because an opening of the path 130*a* is provided on the plane where the collecting section 6*a* is present, it can serve to guide the fiber bundle F to the yarn drawing passage 23 from the vicinity of the collecting section 6*a*. The recess 129 and the path 130*a* comprise a yarn path 130.

Figure 10:
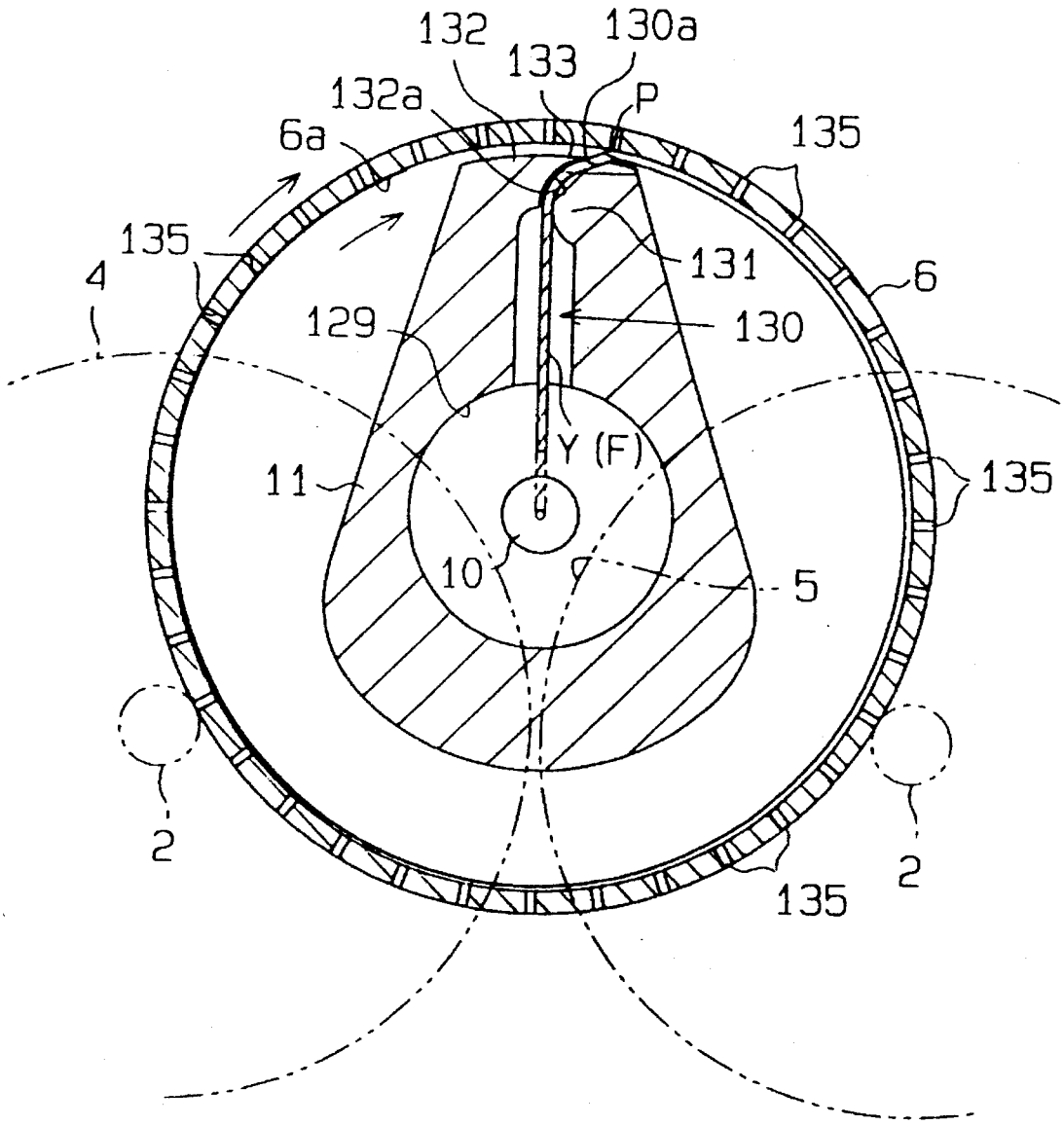
FIG. 10 is a cross-sectional view taken along the line 10—10 in FIG. 8.

As shown in FIG. 10, a first guide 131, which leads or is positioned forward of the inner rotor 11, is provided in the proximity of the path 130*a* of the inner rotor 11. This first guide 131, like the first guide 32 in FIG. 1, has a substantially semi-cylindrical shape. Therefore, the first guide 131 can contact the fiber bundle F (yarn Y), which is led to the yarn drawing passage 23, from the forward or leading side. A wall 132 having a surface 132*a* which extends along the curved surface of the first guide 131 is formed so as to confront the curved surface of the first guide 131. The distal end of the wall 132 leads or is forward of the curved surface of the first guide 131. This distal end forms a second guide 133.

Multiple vent holes 135 which permit the collecting section 6*a* to communicate with the outer surface of the outer rotor 6 are formed in the outer rotor 6 at predetermined pitches. The vent holes 135 extend in a direction perpendicular to the shaft 10.

When the outer rotor 6 and inner rotor 11 of this embodiment rotate, opened fibers are collected at the collecting section 6*a* to become a fiber bundle F as in the previously discussed embodiments. The fiber bundle F, which is linked to the yarn Y, is separated from the collecting section 6*a* in accordance with the drawing of the yarn Y, and is spun while being twisted. Twisting applied to the yarn Y and the fiber bundle F is transmitted to the collecting section 6*a* of the outer rotor 6 from the end portion 25*a* of the yarn pipe 25 as the starting point.

Since the vent holes 135 are so formed as to communicate with the bottom of the collecting section 6*a* of the outer rotor 6, an airstream directed outward of the outer rotor 6 from the collecting section 6*a* is generated in the vent holes 135 due to the self-exhausting action as the outer rotor 6 rotates fast. As the interior of the casing 26 is held in a reduced pressure state, an airstream directed outward of the outer rotor 6 is also generated in the vent holes 135 by the reduced pressure action. This airstream causes the fiber bundle F collected at the collecting section 6*a* to be pressed against the collecting section 6*a*.

Accordingly, the fiber bundle F is twisted at the separation point P while being firmly pressed against the collecting section 6*a*, thus suppressing the rotation of the fiber bundle F at the upstream of the separation point P. Thus, yarn having an excellent appearance is spun and a fabric produced with this yarn has a good texture. When the fibers which slide on the inner wall of the outer rotor 6 toward the collecting section 6*a* reach the collecting section 6*a*, the fibers are pressed on the collecting section 6*a* and restricted there by the aforementioned airstream. Even if the fiber bundle F at the upstream of the separation point P is twisted slightly, therefore, the fibers, before becoming a fiber bundle, are not loosely wound around the fiber bundle F in an unrestricted state, unlike in the prior art. This prevents a disturbance in the appearance of the produced yarn and prevents the deterioration of the texture of the resulting fabric. Since the fiber bundle F is pressed on the collecting section 6*a* by an airstream, the spinning frame of this embodiment has fewer components to wear out as compared with the apparatus that uses a roller or the like to mechanically press the fiber bundle F on the collecting section.

Both guides 131 and 133 and the wall 132 in this embodiment also serve the same purposes as those of the embodiments discussed previously.

By adjusting the negative pressure from the negative pressure source 134, the amount of air exhausted from the vent holes 135 is adjusted to change the force that presses the fiber bundle F on the collecting section 6*a*. It is therefore possible to apply an appropriate pressing force on the fiber bundle F by adjusting the negative pressure in accordance with the spinning conditions.

Figure 11:
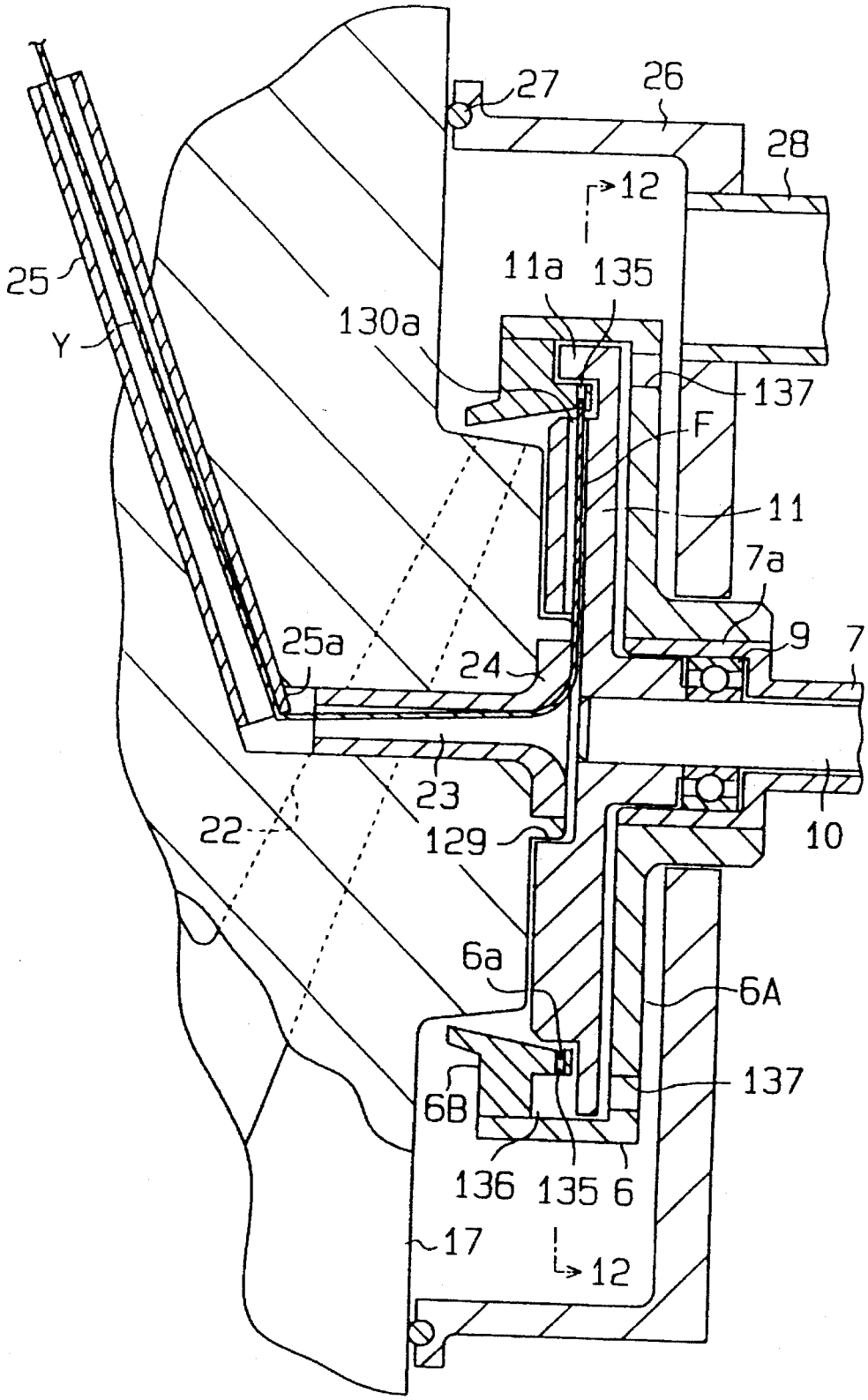
FIG. 11 is a partial enlarged cross-sectional view of a sixth embodiment.
Figure 12:
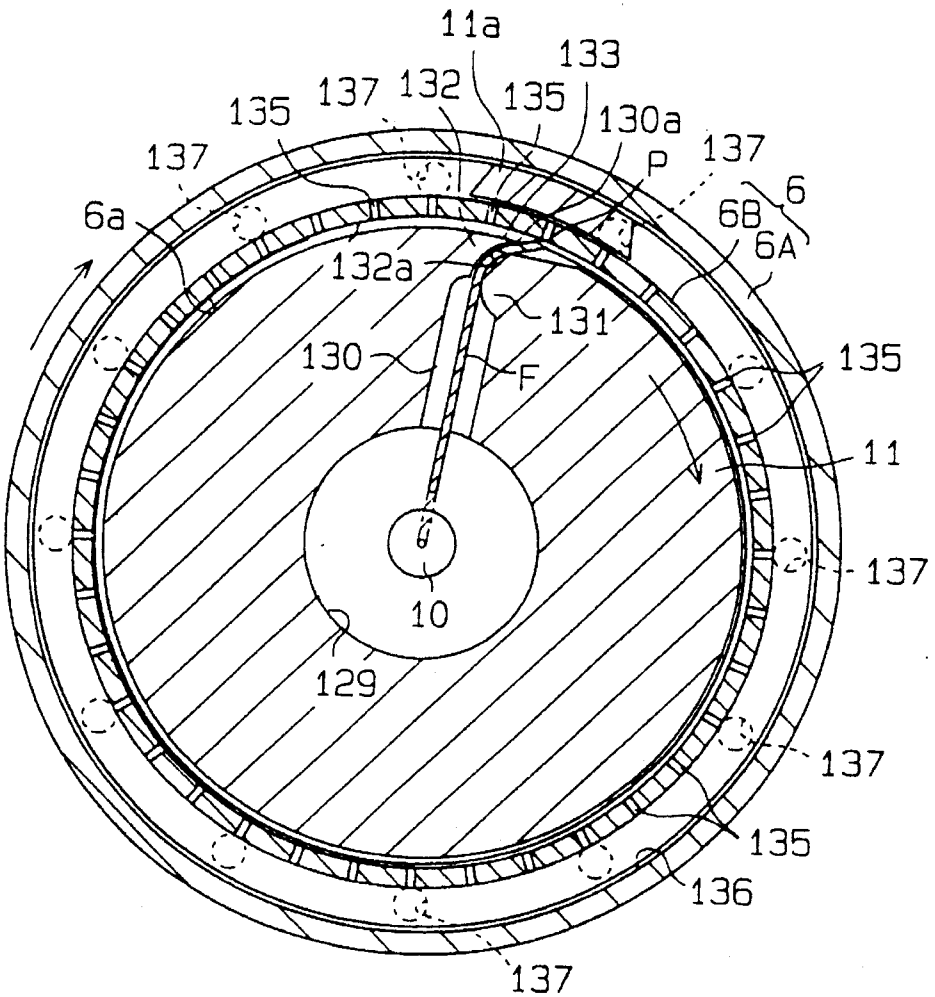
FIG. 12 is a cross-sectional view taken along the line 12—12 in FIG. 11.

A sixth embodiment will now be described with reference to FIGS. 11 and 12. This embodiment differs from the above-described embodiments in the structures of the outer rotor 6 and inner rotor 11, but is the same as those embodiments in the remaining structure. As shown in FIGS. 11 and 12, an annular negative pressure chamber 136 (a negative pressure section) is formed in the outer rotor 6 outside the collecting section 6*a*. Multiple exhaust holes 137 are formed in, for example, the bottom of the negative pressure chamber 136 to connect this chamber 136 to the outside of the outer rotor 6. The outer rotor 6 comprises a body 6A and an annular portion 6B. The body 6A has the exhaust holes 137 in its bottom, and is fitted on the rotor shaft 7. The annular portion 6B has the collecting section 6*a* and is securely fitted on the body 6A by press fitting or the like. Multiple vent holes 135 are formed in the annular portion 6B so as to face the bottom of the collecting section 6*a*.

The inner rotor 11 is formed like a disk whose outside diameter is larger than the diameter of the collecting section 6*a*, so that the inner rotor 11 covers the exhaust holes 137 of the outer rotor 6. A cover 11*a* which faces the path 130*a* protrudes from the inner rotor 11 to cover the vent holes 135 from the negative pressure chamber side. In this embodiment, the cover 11*a* has such a length as to cover three vent holes 135 at a time.

While the spinning frame of this embodiment is running, air in the outer rotor is exhausted from the exhaust holes 137 based on the negative pressure in the casing 26, causing the negative pressure chamber 136 to have negative air pressure. As a result, an airstream which passes through the vent holes 135 from the collecting section 6*a* is generated to press the fiber bundle F at the collecting section 6*a*against this collecting section 6*a*. Accordingly, this embodiment performs the same action and has the same advantages as the above-discussed embodiments.

Because the vent holes 135 near the separation point P are covered with the cover 11*a* in this embodiment, the force that presses the fiber bundle F, separated from the collecting section 6*a*, on the collecting section 6*a* is lower and the drawing resistance of the fiber bundle F decreases. Consequently, the spinning becomes easier and this spinning frame is suitable particularly when soft twisting is performed, i.e. twisting is set low.

Figure 13:
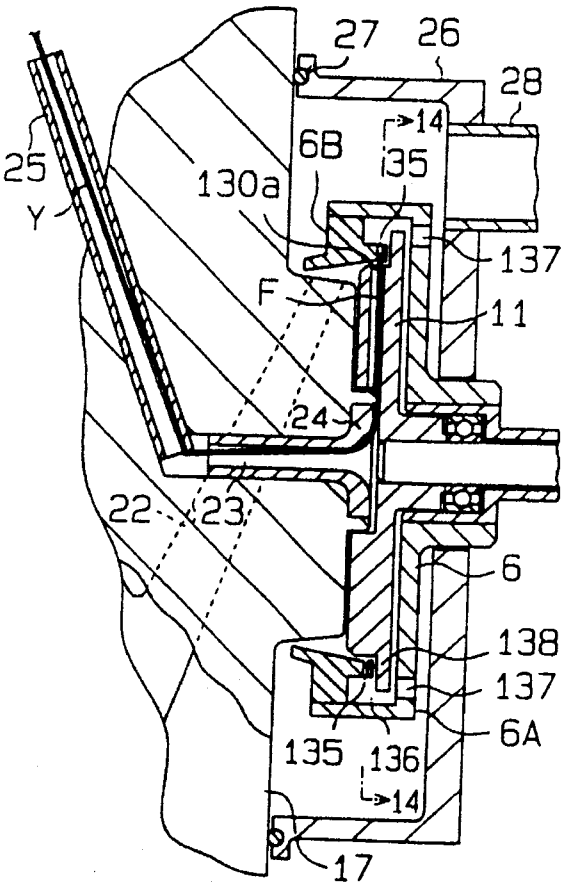
FIG. 13 is a partial enlarged cross-sectional view of a seventh embodiment.
Figure 14:
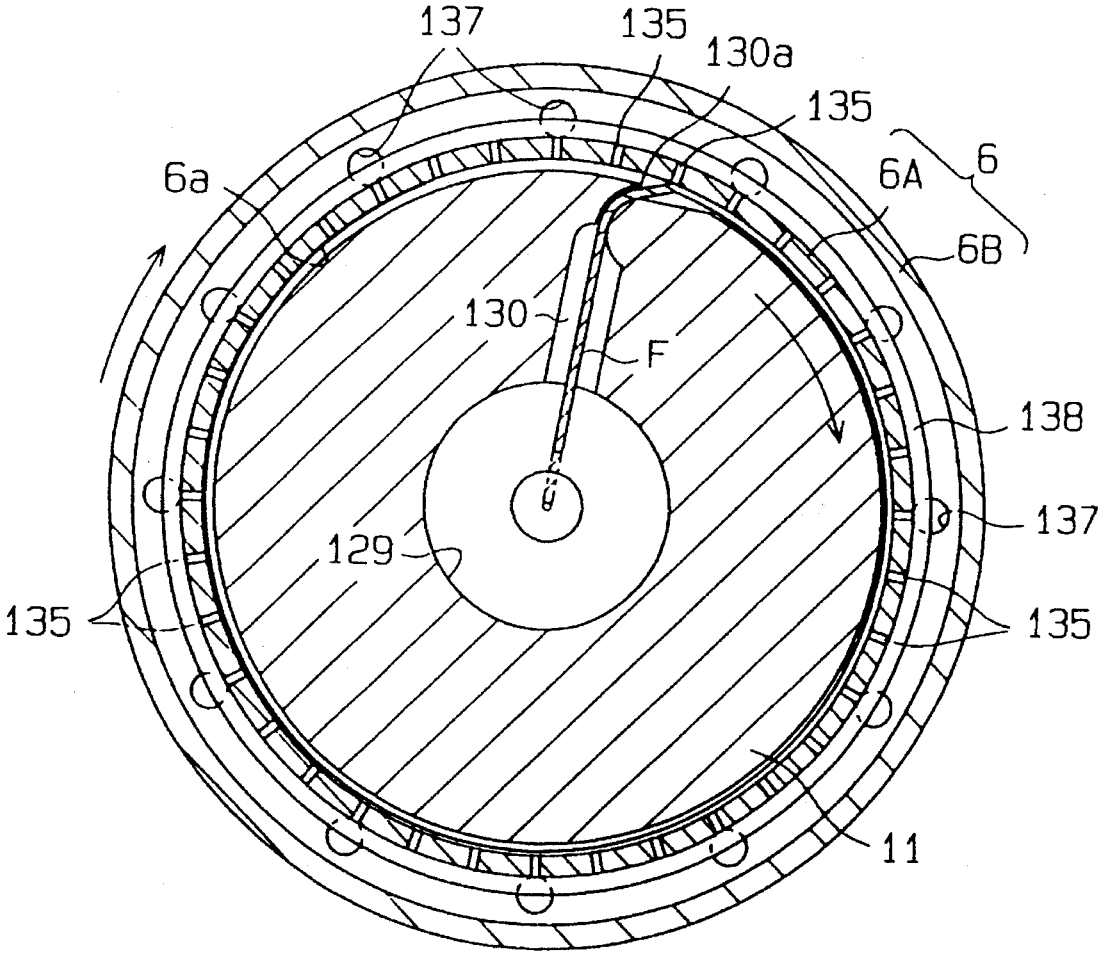
FIG. 14 is a cross-sectional view taken along the line 14—14 in FIG. 13.

A seventh embodiment will now be described with reference to FIGS. 13 and 14. This embodiment differs from the sixth embodiment only in the shape of the inner rotor 11. A flange 138 which partly covers the exhaust holes 137 is formed in association with the bottom of the outer rotor 6. The flange 138 is so arranged as to reduce the clearance between the annular portion having the vent holes 135 and the collecting section 6*a*.

Accordingly, an airstream enters the negative pressure chamber 136 of the outer rotor 6 mainly from the vent holes 135 in accordance with the amount of air exhausted from the exhaust holes 137. The amount of exhausted air from the exhaust holes 137 is changed by changing the amount of coverage of the exhaust holes 137 by the flange 138 so that the pressing force on the fiber bundle F at the collecting section 6*a* can be changed by using the inner rotor 11, whose flange 138 has a different outside diameter. If inner rotors 11 with different outside diameters are prepared in association with the spinning conditions, therefore, even when the spinning frame is operated with the pressure in the negative pressure source 134 set constant, the pressing force that best matches the spinning conditions can be secured.

Figure 15:
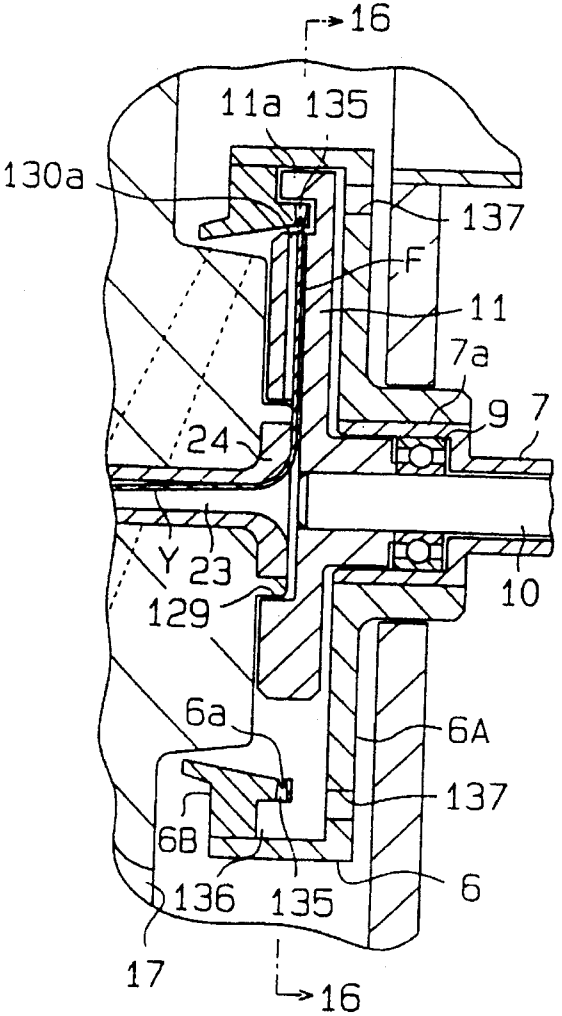
FIG. 15 is a partial cross-sectional view of an eighth embodiment.
Figure 16:
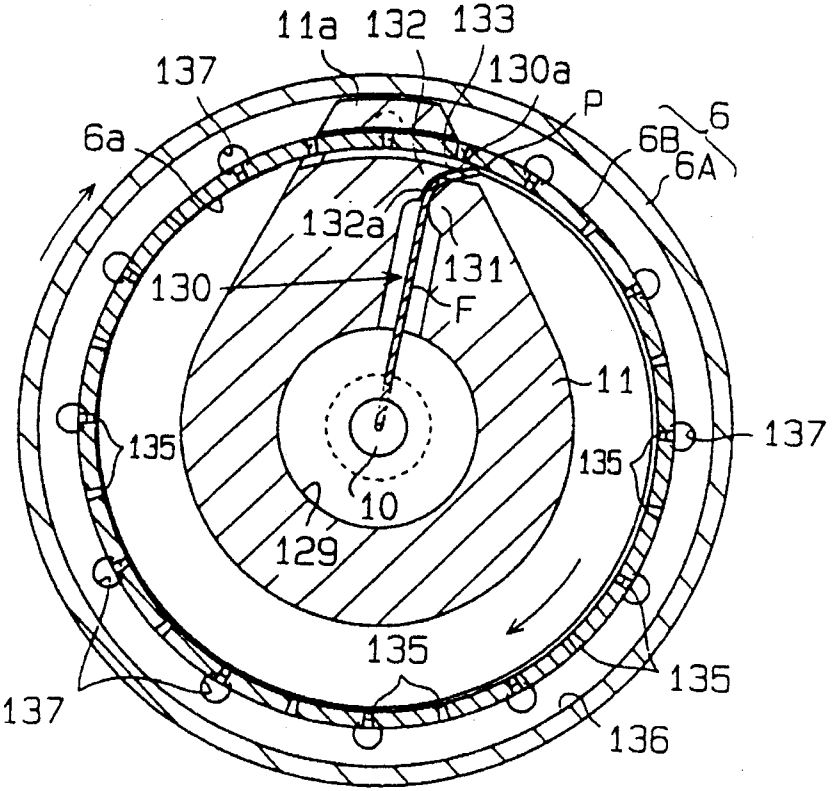
FIG. 16 is a cross-sectional view taken along the line 16—16 in FIG. 15.

An eighth embodiment will now be described with reference to FIGS. 15 and 16. This embodiment differs from the sixth embodiment only in the shape of the inner rotor 11 and the shape of the vent holes 135. The inner rotor 11 is shaped in such a manner that the circumferential length of its maximum diameter portion is equal to the length of the cover 11*a* that covers the vent holes 135, and the inner rotor 11 is symmetrical with respect to the straight line that passes the center of the cover 11*a* and the rotational center of the inner rotor 11. The center of gravity of the inner rotor 11 coincides with the rotational center. The cover 11*a* is arranged rearward of or lagging the opening of the path 130*a*.

Each vent hole 135 has a circular cross section along its entire length, and is shaped in such a way that its diameter is the minimum on the collecting section (6*a*) side and gradually increases in the opposite direction. The minimum diameter portion of the vent hole 135 is set so as to permit the passing of dust such as short fibers unfit to form yarn, waste leaves or waste seeds, and restricts the passing of fibers effective to form yarn. The minimum diameter portion of the vent hole 135 should be almost 1 mm or less, preferably about 0.5 mm. This diameter differs depending on the operation conditions. When this diameter is greater than 1 mm, too many effective fibers are undesirably discharged. When the diameter is smaller than 0.5 mm, dust is not discharged, making clogging easier.

In addition to the same action and advantages as the sixth embodiment, therefore, this embodiment has such a feature to suppress the occurrence of clogging when dust such as short fibers unfit to form yarn, waste leaves or waste seeds, which have been supplied with the proper fibers into the outer rotor, are discharged from the vent holes 135. With vent holes 135 having a constant diameter, when the size of dust which has entered the vent holes 135 is close to the size of the vent holes 135, the dust may cause clogging midway in each vent hole 135. According to this embodiment, however, each vent hole 135 gradually becomes larger toward the exit from the entrance, i.e., from the collecting section (6*a*) side, so that the dust having entered the vent hole 135 smoothly moves toward the exit and will not cause clogging.

Figure 17A:
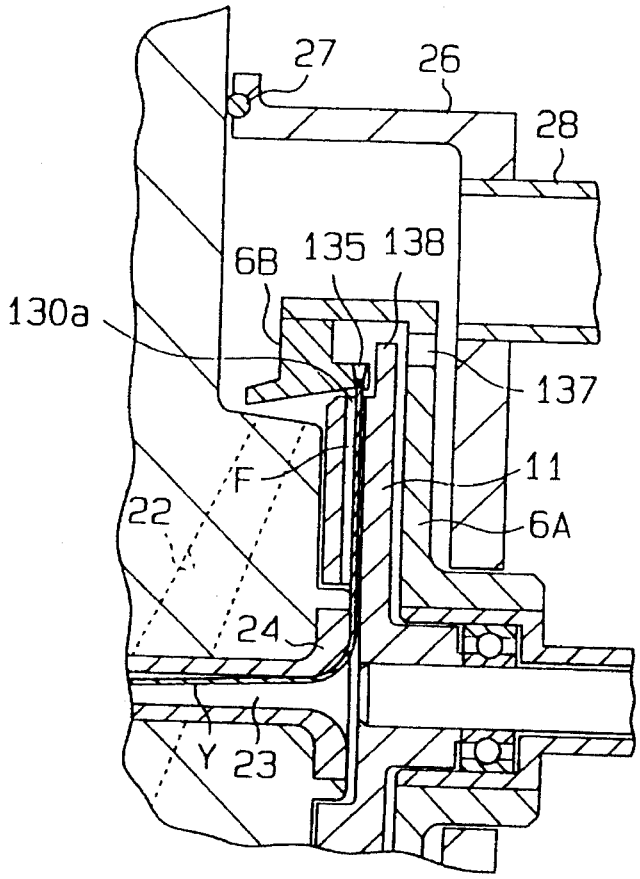
FIG. 17(*a*) is a partial enlarged cross-sectional view of a ninth embodiment, and FIG. 17(*b*) is an enlarged view of a vent hole.
Figure 17B:
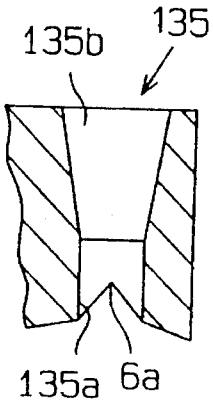
Figure 18:
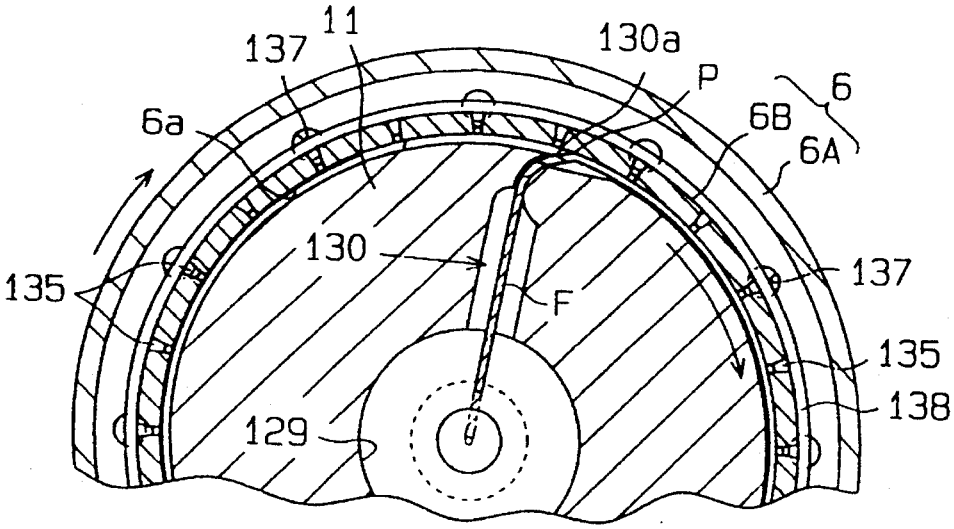
FIG. 18 is a partial enlarged cross-sectional view of the ninth embodiment.

A ninth embodiment will now be described with reference to FIGS. 17 and 18. This embodiment differs from the seventh embodiment only in the shape of the vent holes 135. As shown in FIG. 17B, each vent hole 135 has a small diameter portion 135*a* and a tapered portion 135*b* extending from the small diameter portion 135*a* that is provided on the collecting section (6*a*) side. The small diameter portion 135*a* has a uniform inside diameter which is set equal to the diameter of the minimum diameter portion of the vent holes 135 of the eighth embodiment. The tapered portion 135*b* is formed in such a way that its inside diameter gradually increases toward the exit.

This embodiment therefore has a feature to suppress the occurrence of clogging when dust which has been supplied with the proper fibers into the outer rotor, is discharged from the vent holes 135. In addition, this embodiment exhibits the same action and advantages as the sixth embodiment.

This invention may be embodied in the following forms:

The entire inner rotor 11 may be formed of ceramics. In this case, wearing of the first guide 31 and second guide 33 is reduced to improve durability. When the entire inner rotor 11 is formed of ceramics, desirable ceramic materials include alumina, aluminum nitride (AlN), silicon carbide or boron nitride, which have excellent wear resistance.

In the second to fourth embodiments, both of the first guide 31 and second guide 33 may be formed of ceramics. In this case, both guides 31 and 33 have an improved durability and are easy to replace. In the fifth to ninth embodiments, only the first guide 131 and second guide 133 may be formed of ceramics. In this case, the first guide 131 and the second guide 133 experience reduced wearing and have an improved durability. Further, when the spinning frame is so worn after long use that it requires replacing, both guides 131 and 133 need only to be replaced. No replacement of the entire inner rotor 11 is required.

Figure 5:
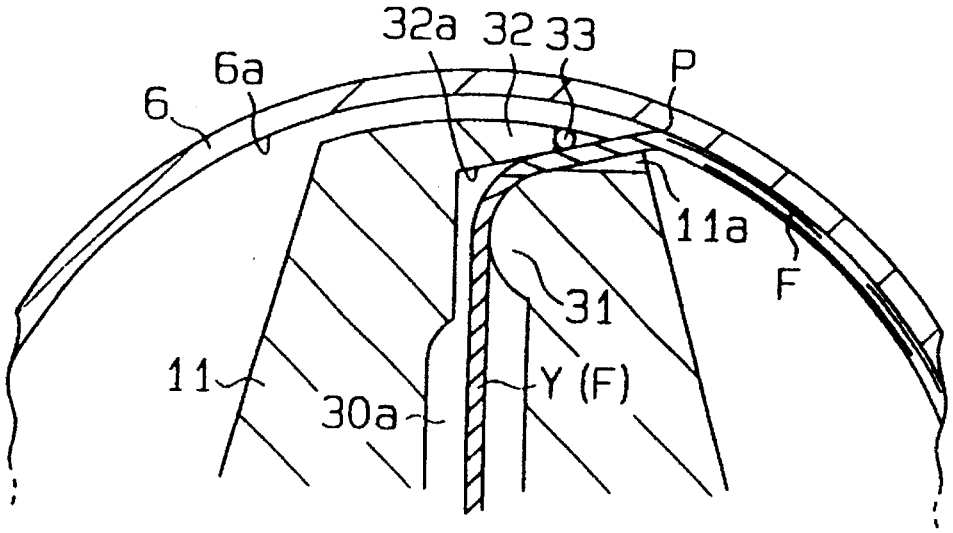
FIG. 5 is a partial enlarged cross-sectional view of a third embodiment.

The second guide 33 or 133 may be structured to protrude alone, without the wall 32 or 132, which be accomplished by eliminating the wall 32 in FIG. 5. In this case too, the fiber bundle F separated at the separation point P does not contact the inner wall of the outer rotor 6, even when the centrifugal force acts on the fiber bundle F, so that the fiber bundle F is guided to the first guide while the twisting angle is kept obtuse.

The entire inner rotor 11 may be formed symmetric with respect to the rotational axis by providing an extending portion having substantially the same shape as the portion where the yarn path is formed, on the opposite side of the inner rotor 11 to the yarn and by extending the extending portion to the vicinity of the collecting section 6*a*.

This invention may also be embodied in the following forms.

The intensity of the forced exhaustion may be set in accordance with the spinning conditions based on the relation between the intensity of the forced exhaustion or the power of the negative pressure source 134 and the pressing force acting on the fiber bundle F at the collecting section 6*a*, which has been previously determined through test spinning.

The number and size of vent holes 135 and the pitch between the vent holes 135 may be changed as needed. Further, the number and size of exhaust holes 137 and the pitch between the exhaust holes 137 may be changed as needed. When the power of the negative pressure source 134 is set constant, the level of the negative pressure from the negative pressure chamber 136 can be adjusted by changing the number and/or size of the exhaust holes 137.

The cover 11*a* formed on the inner rotor 11 in the sixth embodiment may be formed so as to cover the vent holes 135 which are positioned in the vicinity of the opening for the introduction of the fiber bundle excluding the portion located on the forward side in the rotational direction of the inner rotor 11. In this case, because an airstream flows to the negative pressure chamber 136 mainly from the vent holes 135 near the separation point P, the pressing force on the fiber bundle F near the separation point P becomes stronger even when the power of the negative pressure source 134 and the number of rotations of the inner rotor 11 are the same.

In the ninth embodiment, the portion of the inner rotor 11, which is opposite to where the path 130*a* of the inner rotor 11 is formed, may be formed to extend to the vicinity of the collecting section 6*a* so that the entire inner rotor 11 is formed symmetrical with respect to the rotational axis or is formed in a disk shape. That is, the inner rotor 11 may take any shape as long as the dynamic balance can be maintained.

Figure 19A:
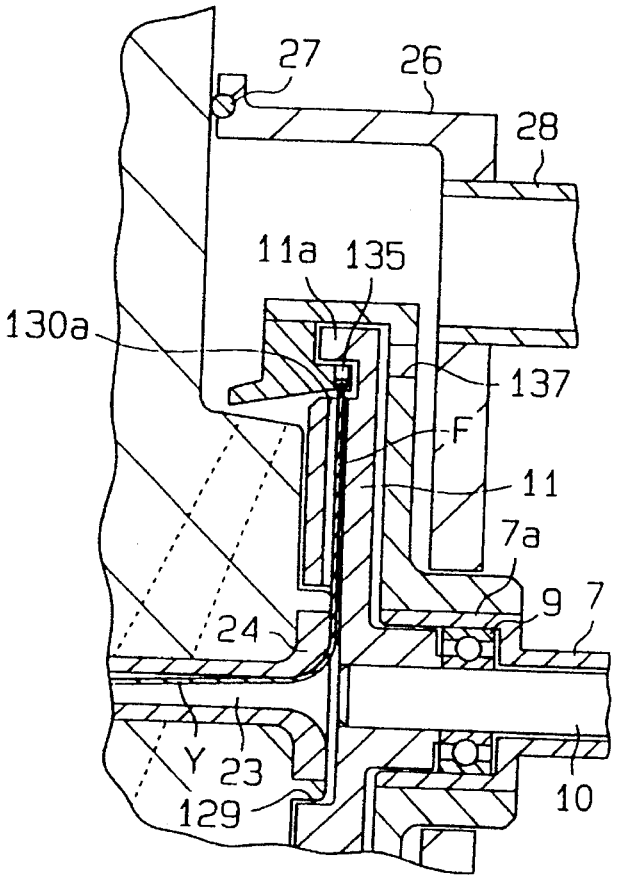
FIG. 19(*a*) is a partial enlarged cross-sectional view of a modification, and FIG. 19(*b*) is an enlarged view of a vent hole.
Figure 19B:
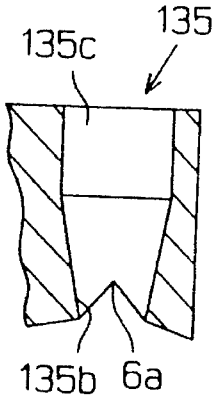
Figure 20:
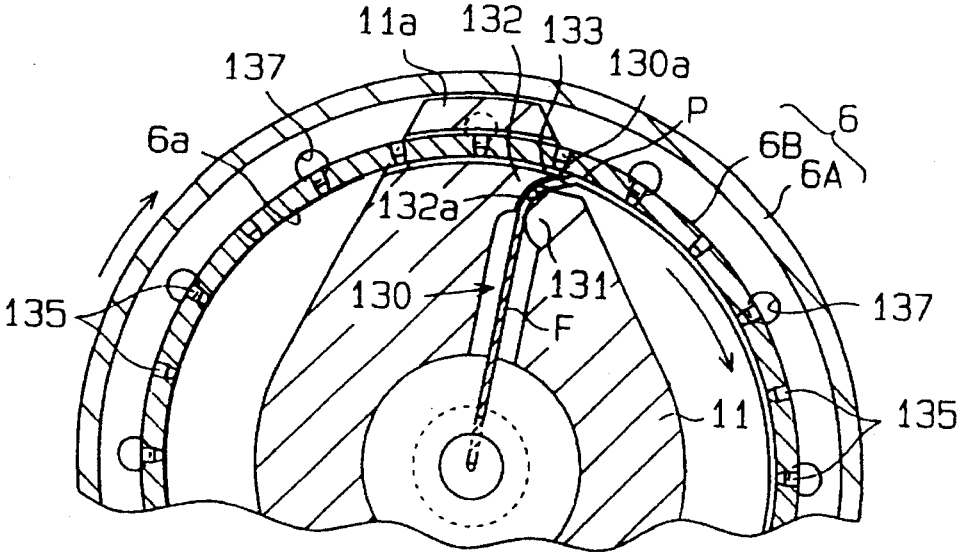
FIG. 20 is a partial enlarged cross-sectional view of this modification.

As shown in FIGS. 19(*a*), 19(*b*) and 20, each vent hole 135 in the eighth embodiment may include a tapered portion 135*b* provided on the collecting section (6*a*) side and a large diameter portion 135*c* extending from the tapered portion 135*b*. The minimum diameter of the tapered portion 135*b* is set the same as the minimum diameter of the vent hole 135. Dust can be smoothly discharged from the vent holes 135 in this case.

Figure 21:
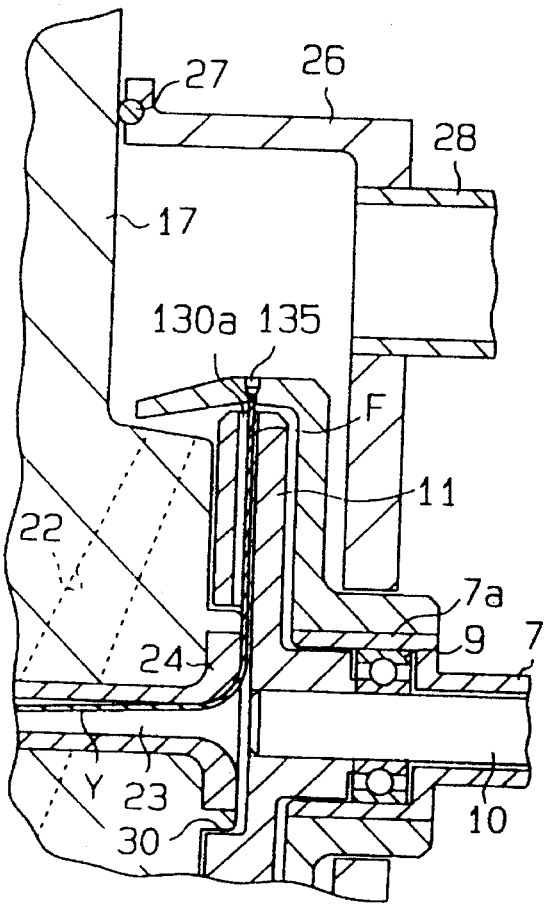
FIG. 21(*a*) is a partial cross-sectional view of another modification, and FIG. 21(*b*) is an enlarged view of a vent hole.
Figure 21:
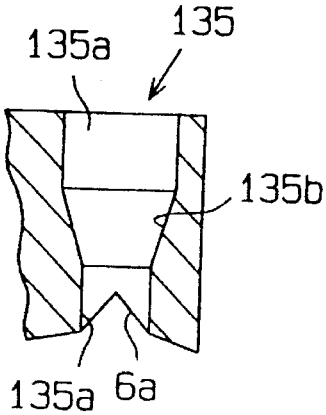
Figure 22:
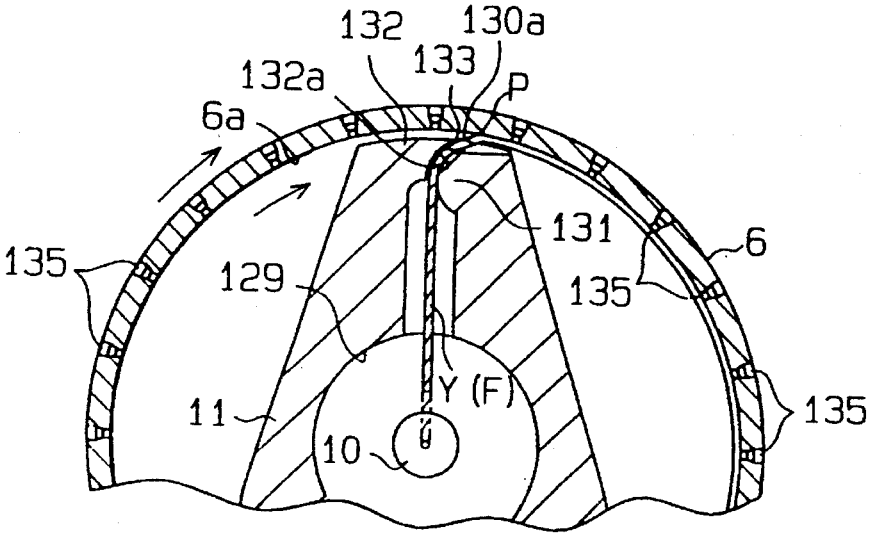
FIG. 22 is a partial enlarged cross-sectional view of this modification.

As shown in FIGS. 21(*a*), 21(*b*) and 22, each vent hole 135 in the ninth embodiment may be constituted by a small diameter portion 135*a* provided on the collecting section (6*a*) side, a tapered portion 135*b* and a large diameter portion 135*c*. Dust can be smoothly discharged from the vent holes 135 in this case.

Figure 23A:
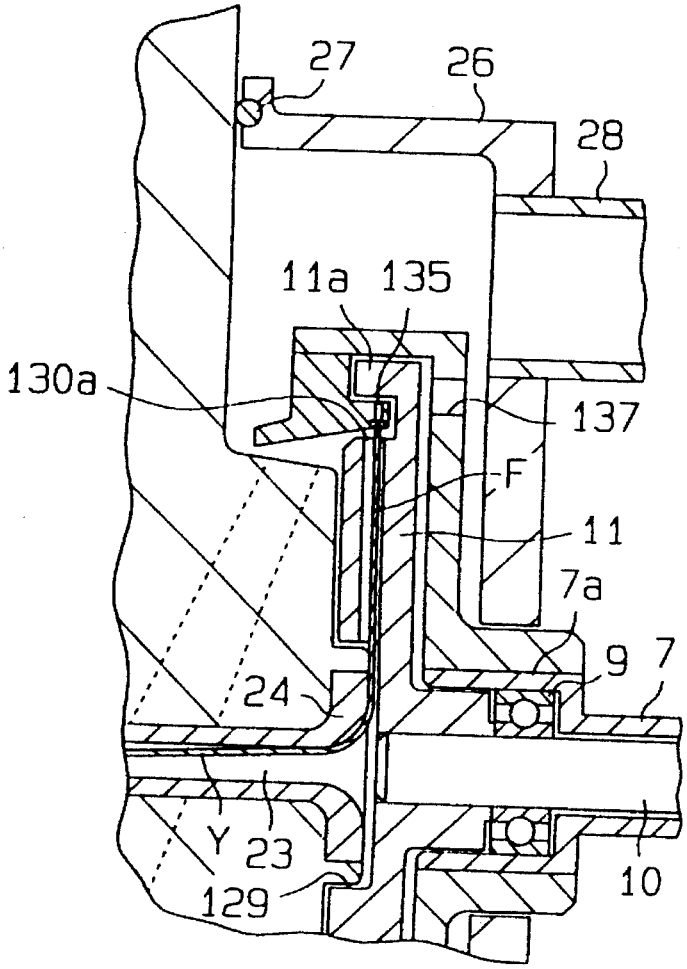
FIG. 23(*a*) is a partial enlarged cross-sectional view of a further modification, and FIG. 23(*b*) is an enlarged view of a vent hole.
Figure 23B:
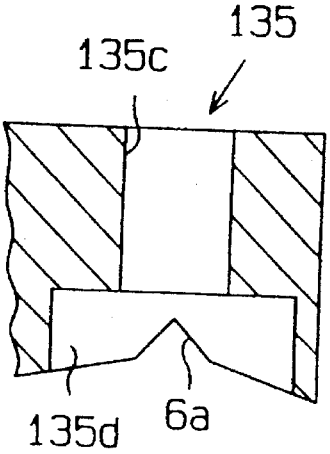
Figure 24:
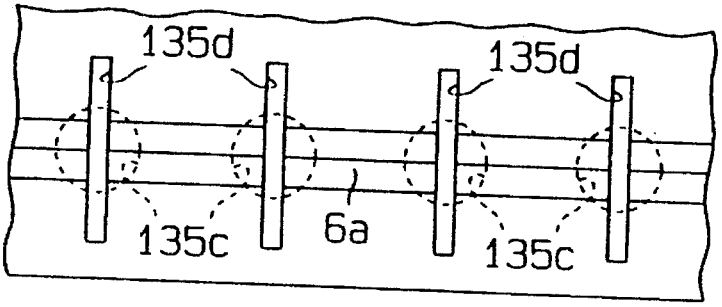
FIG. 24 is a partial enlarged cross-sectional view of this modification.

The cross-sectional shape of the vent hole 135 may take other shapes than the circular shape, or may consist of a circular cross-sectional portion and a portion of another shape. As shown in FIGS. 23(*a*), 23(*b*) and 24, for example, the vent hole 135 may be constituted by an elongated groove 135*d*, which has a rectangular cross section and is provided on the collecting section (6*a*) side to extend perpendicular to the collecting section 6*a*, and a large diameter portion 135*c* whose diameter is greater than the width of the groove 135*d* or the length thereof along the extending direction of the collecting section 6*a*. Dust can be smoothly discharged from the vent holes 135 in this case. FIG. 24 is a partly enlarged view showing around the collecting section 6*a* of the outer rotor 6.

In the above-described embodiments and modifications, the vent holes 135 may be formed, not radially, but in such a way that the exit of the vent hole located opposite to the collecting section extends in the direction opposite to the rotational direction of the outer rotor 6 with respect to the entrance. In this case, the amount of air moving toward the negative pressure chamber 136 from the vent holes 135 increases. The vent holes 135 may be formed so as to obliquely extend toward the opening side or the bottom of the outer rotor 6, not on the plane perpendicular to the shaft 10.

Figure 25:
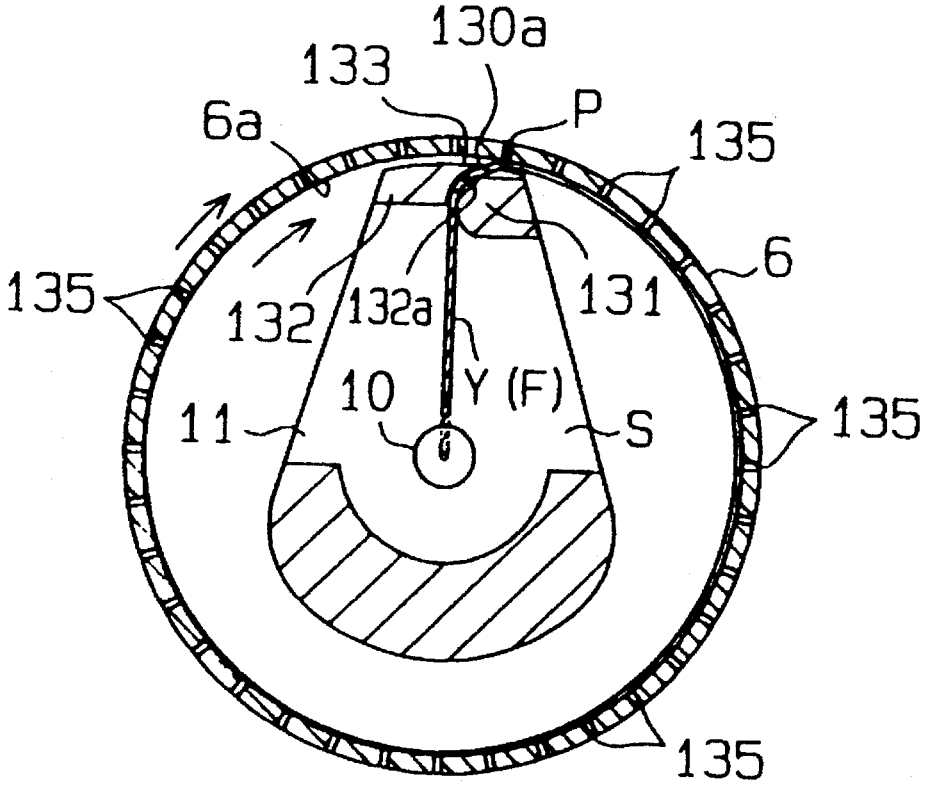
FIG. 25 is a cross-sectional view of a still further modification.
Figure 26:
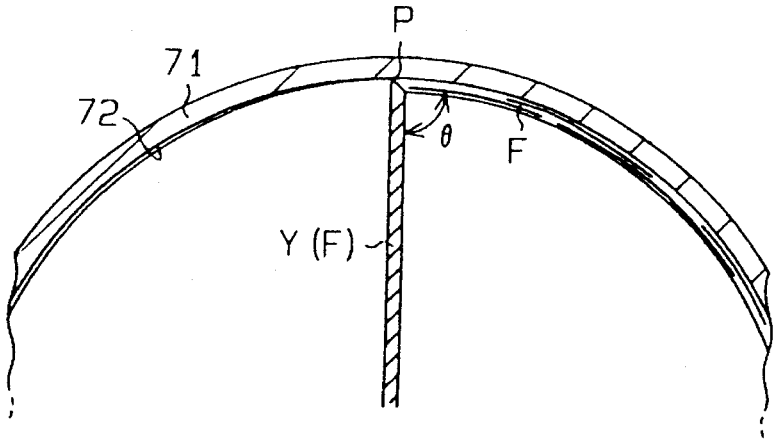
Fig.26 (Prior Art)
FIG. 26 is an exemplary diagram showing the relationship between a drawn fiber bundle and a yarn-collecting section according to prior art.
Figure 27:
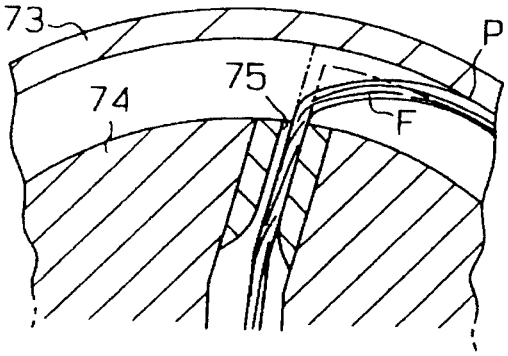
Fig.27 (Prior Art)
FIG. 27 is a partial enlarged cross-sectional view of other prior art.
Figure 28A:
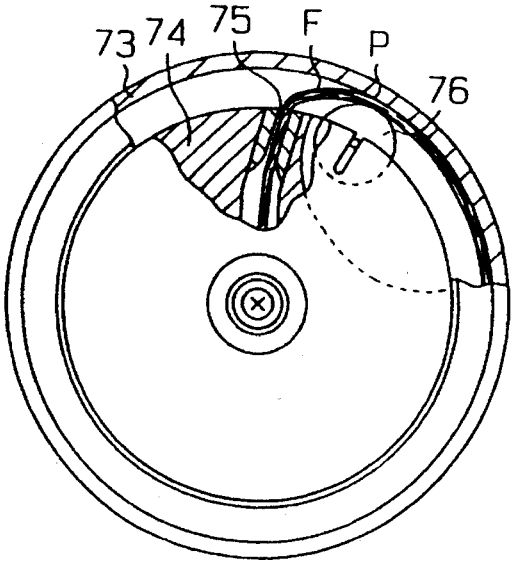
Fig.28(a) (Prior Art)
FIG. 28(*a*) is a partial cut-away plan view of further prior art, and FIG. 28(*b*) is a partial enlarged view of the prior art of FIG. 28(*a*).
Figure 28B:
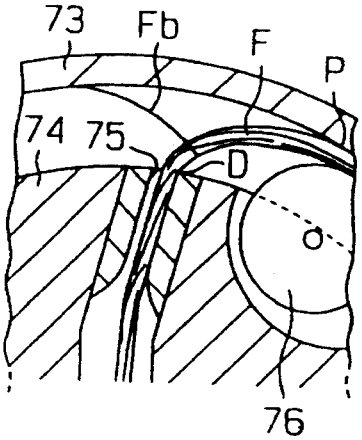
Fig.28(b) (Prior Art)

The fiber-bundle introducing opening 130 which leads the fiber bundle F, collected at the collecting section 6*a*, to the yarn drawing passage 23 is not limited to the passage that continuously extends to the yarn drawing passage 23, but should only have a portion for guiding the fiber bundle F to the vicinity of the collecting section 6*a*. As shown in FIG. 25, for example, the inner rotor 11 may be provided with the first guide 131 and second guide 133, with open space S being defined between the first guide 131 and the yarn drawing passage 23.

Therefore, the present examples and embodiments are to be considered as illustrative and not restrictive and the invention is not to be limited to the details given herein, but may be modified within the scope of the appended claims.

What is claimed is:

1. A rotor type open-end spinning unit in which a supply of opened fiber is fed to a collecting section to form a fiber bundle, and in which said fiber bundle is twisted and drawn through a yarn drawing passage to spin a yarn, said spinning unit comprising:

a rotatable outer rotor having an open end, a closed end and a circumferential wall joined to said closed end, said circumferential wall having said collecting section on an inner surface thereof, said collecting section being located in a plane normal to the rotational axis of the rotor;

an inner rotor located inside the outer rotor and being driven independently from the outer rotor, said inner rotor being located at the upstream end of the yarn drawing passage;

a yarn path provided in the inner rotor for guiding the fiber bundle from the collecting section to the yarn drawing passage;

a first guide provided on the inner rotor for contacting the fiber bundle and guiding the fiber bundle to the yarn drawing passage through the yarn path from a leading location in the direction of rotation of the inner rotor relative to the yarn path, said first guide having a curved surface for contacting the fiber bundle; and a second guide located on the inner rotor radially outward between the first guide and the inner surface of the outer rotor, said second guide serving to guide the fiber bundle toward the yarn path in cooperation with the first guide.

2. A spinning unit according to claim 1, further comprising a wall on the inner rotor extending in the counter-rotational direction from adjacent the second guide for preventing the fiber supplied to the collecting section from entering the yarn path from locations radially outward of the second guide.

3. A spinning unit according to claim 2, wherein said wall has a guide surface curved in a manner similar to the curved surface of the first guide.

4. A spinning unit according to claim 1, wherein at least a portion of said yarn path is located in a plane normal to the axis of rotation of the rotor.

5. A spinning unit according to claim 1, wherein said yarn path is offset from the plane of the yarn collecting section axially toward the closed end of the outer rotor.

6. A spinning unit according to claim 1, wherein said inner rotor is made of ceramic material.

7. A spinning unit according to claim 1, wherein said second guide is located forward of the first guide in the direction of rotation of the inner rotor.

8. A spinning unit according to claim 7, wherein said first guide includes a cylindrical pin made of ceramic material.

9. A spinning unit according to claim 6, wherein said second guide includes a cylindrical pin made of ceramic material, said first guide having a curved surface of a first diameter, and said pin having an outer diameter smaller than said first diameter of the first guide.

10. A spinning unit according to claim 1, wherein said outer rotor has a plurality of circumferentially spaced vent holes communicating the collecting section with the radially outer surface of the circumferential wall, whereby said fiber bundle is pressed against the collecting section by a difference in air pressure existing on opposite sides of said circumferential wall during operation of the spinning unit.

11. A spinning unit according to claim 10, wherein said outer rotor has a peripheral wall joined at one end to said closed end, and said circumferential wall has a smaller diameter than said peripheral wall and is supported reentrantly from the other end of said peripheral wall spaced radially inward from and concentric with said peripheral wall whereby a negative pressure chamber of annular configuration is formed between said circumferential and peripheral walls, said spinning unit further comprising;

an exhaust hole formed through the closed end of the outer rotor for communicating the negative pressure chamber with the outside of the outer rotor;

wherein said vent holes communicate the collecting section with the negative pressure chamber; and a cover member provided near the yarn path for covering the vent holes on the negative pressure chamber side.

12. A spinning unit according to claim 10, wherein said outer rotor has a peripheral wall joined at one end to said closed end, and said circumferential wall has a smaller diameter than said peripheral wall and is supported reentrantly from the other end of said peripheral wall spaced radially inward from and concentric with said peripheral wall whereby a negative pressure chamber of annular configuration is formed between said circumferential and peripheral walls, said spinning unit further comprising:

an exhaust hole formed through the closed end of the outer rotor for communicating the negative pressure chamber with the outside of the outer rotor; and a flange provided on the inner rotor for covering at least a portion of the vent holes.

13. A spinning unit according to claim 10, wherein each vent hole has a size in cross-section which varies in two steps along the longitudinal direction of each vent hole and is formed smaller nearer to the collecting section.

14. A spinning unit according to claim 10, wherein each vent hole has a circular cross-section along its entire length.

15. A spinning unit according to claim 10 further comprising:

a casing for covering the outer rotor; and a negative pressure source for generating a negative pressure in the casing, said negative pressure being adjustable.

16. A rotor type open-end spinning unit in which a supply of opened fiber is fed to a collecting section to form a fiber bundle, and in which said fiber bundle is twisted and drawn through a yarn drawing passage to spin a yarn, said spinning unit comprising:

a rotatable outer rotor having an open end, a closed end and a circumferential wall joined to said closed end, said circumferential wall having said collecting section on an inner surface thereof, said collecting section being located in a plane normal to the rotational axis of the rotor;

an inner rotor located inside the outer rotor and being driven independently from the outer rotor, said inner rotor being located at the upstream end of the yarn drawing passage;

a yarn path provided in the inner rotor for guiding the fiber bundle from the collecting section to the yarn drawing passage;

a first guide provided on the inner rotor for contacting the fiber bundle and guiding the fiber bundle to the yarn drawing passage through the yarn path from a leading location in the direction of rotation of the inner rotor relative to the yarn path, said first guide having a curved surface for contacting the fiber bundle;

a second guide located on the inner rotor between the first guide and the inner surface of the outer rotor, said second guide serving to guide the fiber bundle toward the yarn path in cooperation with the first guide; and a wall located on the inner rotor extending in the counter-rotational direction from adjacent the second guide for preventing the fiber supplied to the collecting section from entering the yarn path from locations radially outward of the second guide.

17. A spinning unit according to claim 16, wherein said inner rotor is made of ceramic material.

18. A spinning unit according to claim 16, wherein said first guide includes a cylindrical pin made of ceramic material.

19. A spinning unit according to claim 16, wherein said second guide includes a cylindrical pin made of ceramic material, said first guide having a curved surface of a first diameter, and said pin having an outer diameter smaller than said first diameter of the first guide.

20. A spinning unit according to claim 16, wherein said second guide is located frontward of the first guide with respect to the rotational direction of the inner rotor.

21. A spinning unit according to claim 16, wherein said outer rotor has a plurality of circumferentially spaced vent holes communicating the collecting section with the radially outer surface of the circumferential wall, whereby said fiber bundle is pressed against the collecting section by a difference in air pressure existing on opposite sides of said circumferential wall during operation of the spinning unit.

22. A spinning unit according to claim 21, wherein said outer rotor has a peripheral wall joined at one end to said closed end, and said circumferential wall has a smaller diameter than said peripheral wall and is supported reentrantly from the other end of said peripheral wall spaced radially inward from and concentric with said peripheral wall whereby a negative pressure chamber of annular configuration is formed between said circumferential and peripheral walls, said spinning unit further comprising:

an exhaust hole formed through the closed end of the outer rotor for communicating the negative pressure chamber with the outside of the outer rotor;

wherein said vent holes communicate the collecting section with the negative pressure chamber; and a cover member provided near the yarn path for covering the vent holes on the negative pressure chamber side.

23. A spinning unit according to claim 21, wherein said outer rotor has a peripheral wall joined at one end to said closed end, and said circumferential wall has a smaller diameter than said peripheral wall and is supported reentrantly from the other end of said peripheral wall spaced radially inward from and concentric with said peripheral wall whereby a negative pressure chamber of annular configuration is formed between said circumferential and peripheral walls, said spinning unit further comprising:

an exhaust hole formed through the closed end of the outer rotor for communicating the negative pressure chamber with the outside of the outer rotor; and a flange provided on the inner rotor for covering at least a portion of the vent holes.

24. A spinning unit according to claim 16, wherein each vent hole has a size in cross-section which varies in two steps along the longitudinal direction of each vent hole and is formed smaller nearer to the collecting section.

25. A spinning unit according to claim 24, wherein each vent hole has a circular cross-section along its entire length.

* * * * *